US009395652B2

(12) United States Patent
Kikuchi et al.

(10) Patent No.: US 9,395,652 B2
(45) Date of Patent: Jul. 19, 2016

(54) DEVELOPING UNIT, PROCESS CARTRIDGE, AND IMAGE FORMING APPARATUS

(71) Applicants: Hiroshi Kikuchi, Kanagawa (JP); Tadashi Ogawa, Tokyo (JP); Hiroyuki Mabuchi, Kanagawa (JP); Junichi Terai, Kanagawa (JP); Hideki Kimura, Kanagawa (JP); Yukio Otome, Ibaraki (JP); Hiroaki Okamoto, Kanagawa (JP); Kazunori Suzuki, Kanagawa (JP)

(72) Inventors: Hiroshi Kikuchi, Kanagawa (JP); Tadashi Ogawa, Tokyo (JP); Hiroyuki Mabuchi, Kanagawa (JP); Junichi Terai, Kanagawa (JP); Hideki Kimura, Kanagawa (JP); Yukio Otome, Ibaraki (JP); Hiroaki Okamoto, Kanagawa (JP); Kazunori Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/844,598

(22) Filed: Sep. 3, 2015

(65) Prior Publication Data

US 2016/0070208 A1 Mar. 10, 2016

(30) Foreign Application Priority Data

Sep. 4, 2014 (JP) ..... 2014-179956

(51) Int. Cl.
*G03G 15/08* (2006.01)

(52) U.S. Cl.
CPC ..... *G03G 15/0891* (2013.01); *G03G 15/0889* (2013.01); *G03G 15/0896* (2013.01); *G03G 2215/0827* (2013.01)

(58) Field of Classification Search
CPC ..... G03G 15/0822; G03G 15/0887; G03G 15/0889; G03G 15/0891; G03G 15/0896
USPC ..... 399/254, 256, 257
See application file for complete search history.

(56) References Cited

U.S. PATENT DOCUMENTS

| | | | | |
|---|---|---|---|---|
| 2008/0181670 | A1* | 7/2008 | Tsuda et al. | 399/234 |
| 2010/0202805 | A1 | 8/2010 | Miyoshi et al. | |
| 2010/0303507 | A1* | 12/2010 | Isono | 399/254 |
| 2011/0008073 | A1 | 1/2011 | Kudo et al. | |
| 2012/0051793 | A1 | 3/2012 | Kudo et al. | |
| 2012/0207492 | A1 | 8/2012 | Fujiwara et al. | |
| 2012/0269555 | A1* | 10/2012 | Matsumoto et al. | 399/258 |
| 2013/0034368 | A1 | 2/2013 | Hattori et al. | |
| 2013/0045029 | A1 | 2/2013 | Kimura et al. | |
| 2013/0064570 | A1 | 3/2013 | Yamane et al. | |
| 2014/0112687 | A1 | 4/2014 | Ohmura et al. | |
| 2015/0023700 | A1 | 1/2015 | Nakamoto et al. | |

FOREIGN PATENT DOCUMENTS

| | | |
|---|---|---|
| JP | 2005-292511 | 10/2005 |
| JP | 2012-177948 | 9/2012 |

* cited by examiner

*Primary Examiner* — Benjamin Schmitt
(74) *Attorney, Agent, or Firm* — Harness, Dickey & Pierce, P.L.C.

(57) ABSTRACT

A developing unit includes a developer bearer to bear developer on a surface thereof, first and second developer conveyors each having a spiral blade mounted on a rotary shaft thereof parallel to a rotary axis of the developer bearer to convey developer in opposite directions to each other. A developer drain hole is provided at a given height in a side wall of a second developer conveyance channel to face a communication opening across the second developer conveyor. The first developer conveyor rotates in a direction with its spiral blade rising between the rotary shaft of the first developer conveyor and the communication opening. Rotational phases of the first developer conveyor and the second developer conveyor are fixed and synchronized with each other to weaken momentum of developer flow generated by the first developer conveyor toward the developer drain hole via the second developer conveyor.

23 Claims, 12 Drawing Sheets

DEVELOPING UNIT, PROCESS CARTRIDGE, AND IMAGE FORMING APPARATUS

CROSS-REFERENCE TO RELATED APPLICATIONS

This patent application is based on and claims priority pursuant to 35 B.S.C. §119 (a) to Japanese Patent Application No. 2014-179956, filed on Sep. 4, 2014, in the Japan Patent Office, the entire disclosure of which is hereby incorporated by reference herein.

BACKGROUND

1. Technical Field

The present invention relates to a developing unit used in an image forming apparatus, such as a printer, a facsimile machine, a copier, etc., a process cartridge having the developing unit, and an image forming apparatus having either the developing unit alone or a process cartridge including the developing unit.

2. Related Art

An image forming apparatus with a developing unit that utilizes two-component developer including toner and magnetic carrier is widely known. To keep the density of toner in the two-component developer within a prescribed range, fresh toner is supplied from a toner container to developer stored in the developing unit as the toner is consumed during the developing process.

In such a system, since carrier included in the developer is used repeatedly although hardly consumed, either a coating (i.e., a surface layer) of the carrier is worn away or toner resins or additives adhere to the coating as image formation is repeated. As the carrier deteriorates, an amount of electric charge carried by the toner also decreases, background dirt and/or splashing of toner or the like occur. As a result, the old carrier is replaced with new carrier on a regular basis. Such maintenance increases unit price of image formation, thereby pushing up the total cost thereof.

One conventional developing unit discharges an excess amount of developer while supplying a prescribed amount of premix developer prepared by blending fresh toner and carrier to developer stored in a developing unit to restore the toner to a prescribed toner density. In such a system, old carrier is discharged little by little from the developing unit as the excess amount of developer is discharged and the new carrier included in the premix developer is supplied to the developer stored in the developing unit. Hence, since discharging and supplying of the developer gradually replaces the old carrier included in the developer with new carrier, carrier replacement can be slowed or omitted altogether.

SUMMARY

Accordingly, one aspect of the present invention provides a novel developing unit that comprises: a developer bearer to bear developer on a surface thereof; a first developer conveyor having a spiral blade mounted on a rotary shaft thereof parallel to a rotary axis of the developer bearer to convey developer in a first direction; and a second developer conveyor having a spiral blade mounted on a rotary shaft thereof parallel to the rotary axis of the developer bearer to convey developer in a second direction opposite the first direction. A first developer conveyance channel includes the first developer conveyor. A second developer conveyance channel includes the second developer conveyor. A partition wall is provided to separate the first developer conveyance channel and the second developer conveyance channel from each other. A communication opening is formed in the partition wall to communicate the first developer conveyance channel with the second developer conveyance channel at a prescribed position near a downstream end of the first developer conveyance channel including the first developer conveyor and an upstream end of the second developer conveyance channel including the second developer conveyor. Each of the downstream end and the upstream end horizontally is aligned there with each other. A developer drain hole is provided to drain the developer from the developing unit. The developer drain hole is provided at a given height in a side wall of the second developer conveyance channel while facing the communication opening across the second developer conveyor. The first developer conveyor rotates in a prescribed direction with its spiral blade rising between the rotary shaft of the first developer conveyor and the communication opening. Rotational phases of the first developer conveyor and the second developer conveyor are fixed and synchronized with each other to weaken momentum of developer flow generated by the first developer conveyor toward the developer drain hole via the second developer conveyor.

Another aspect of the present invention provides a novel process cartridge for an image forming apparatus while including the above-described developing unit to develop a latent image formed on a latent image bearer provided in the image forming apparatus.

Yet another aspect of the present invention provides a novel image forming apparatus that includes: a latent image bearer to bear an electrostatic latent image on a surface thereof; an electrostatic latent image forming device to form the electrostatic latent image on the latent image bearer; and one of the above-described developing unit and a process cartridge having the above-described developing unit to develop the electrostatic latent image formed on the latent image bearer.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
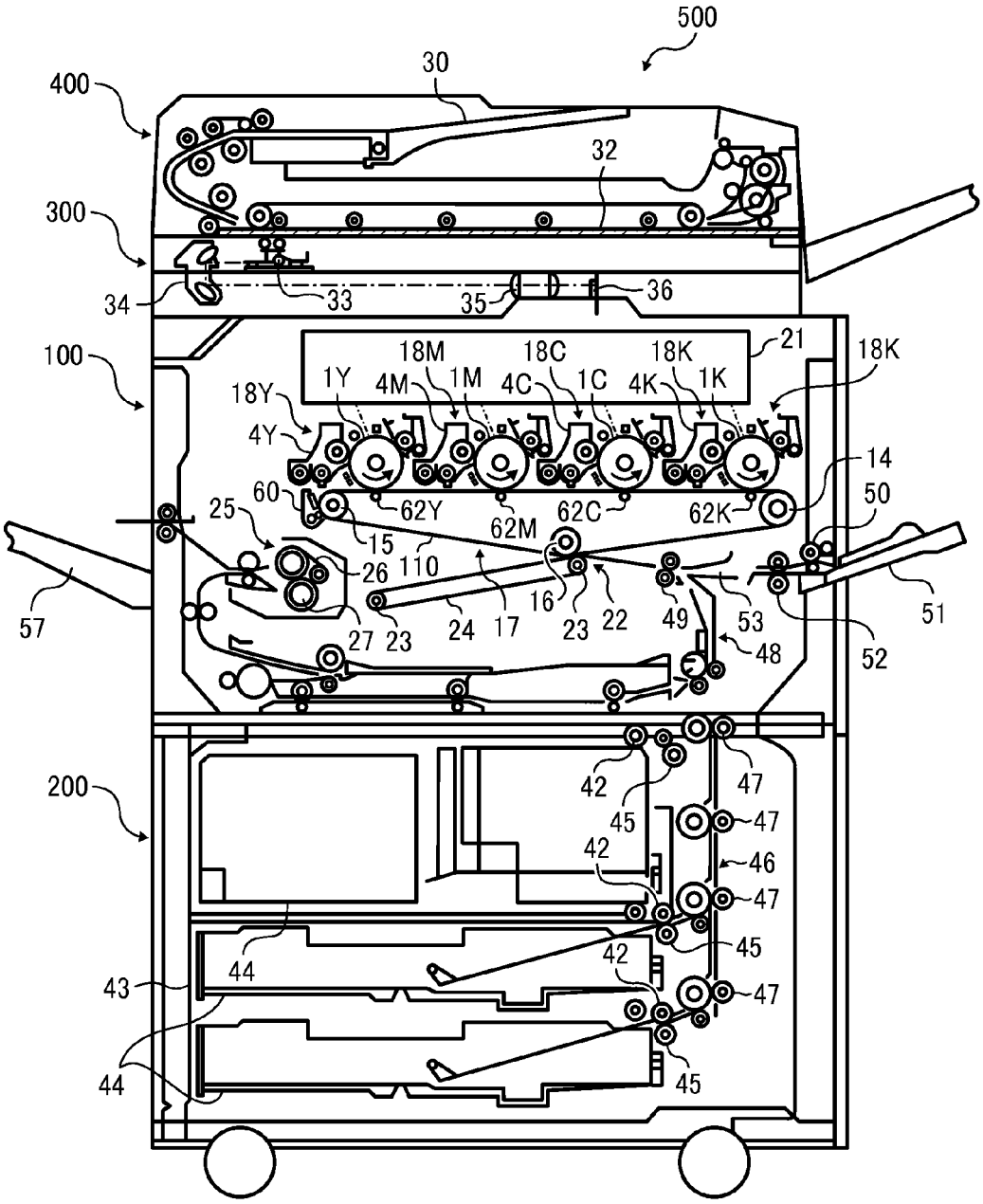
FIG. 1 is a diagram schematically illustrating an exemplary configuration of a copier according to a first embodiment of the present invention.

The above-described conventional developing unit includes a developer bearer to bear developer on a surface thereof, first and second developer conveyors having spiral blades around rotary shafts thereof, respectively, to convey developer in opposite directions to each other in parallel to an axis of the developer bearer. The conventional developing unit also includes first and second developer conveyance channels separated by a partition wall from each other, in which the first and second developer conveyors are disposed, respectively. The conventional developing unit also includes an opening formed on the partition wall to communicate the first developer conveyance channel with the second developer conveyance channel each aligning in the horizontal direction (hereinafter simply referred to as a lateral direction) near a downstream end of the developer conveyance channel for the first developer conveyor and an upstream end of the developer conveyance channel for the second developer conveyor. The conventional developing unit further includes a developer drain hole disposed in a side wall of the second developer conveyance channel, which is located on the opposite side of the partition wall at a prescribed height thereof beside the second developer conveyor in the second developer conveyance channel. With this, developer is discharged out of the developing unit when a height of the developer (i.e., with an amount of increase of the developer) exceeds a lower end of the developer drain hole when it is supplied thereto.

In the above-described conventional system, when a rotational direction of the first developer conveyor is equivalent to a direction, in which a spiral blade rises in a gap between the rotary shaft and the partition wall, and the developer drain hole is located being opposed to the opening formed in the partition wall, the below described problem occurs. Firstly, the developer rushes to laterally flow from the first developer conveyance channel to the second developer conveyance channel, and accordingly a developer flow occurs from below the second developer conveyor to the developer drain hole along a wall surface that forms the second channel. An amount of the above-described developer flow either increases or decreases depending on a position of each of spiral blades changed as the developer conveyors rotate. Accordingly, when each of the spiral blades comes to a prescribed position to readily allow lateral transfer of the developer, the developer flows while almost jumping up from below the second developer conveyor along the wall of the second developer conveyance channel. Subsequently, an upper surface of the developer rises at the developer drain hole opposed to the opening of the partition wall. Consequently, although the total amount of developer stored in the developing unit is not increased up to a prescribed level that necessitates discharging of developer, the developer is undesirably discharged from the developer drain hole.

The above-described phenomenon markedly occurs when either a proper amount of developer or less than that is stored in the developing unit. Because of this, since some developer is discharged from the developer drain hole even if a less amount of developer than a proper level is stored, the amount of developer decreases to be less than a required level, and accordingly developer supply to a latent image bearer such as a drum-shaped photoconductive body (herein below sometimes referred to as a photoconductive drum), etc., likely becomes unstable. When the developer supply to the latent image bearer becomes unstable, an abnormal image such as a drop out, etc., occurs as a result.

Hence, one of the below described various embodiments of the present invention is made in view of the above-described problems, and the purpose thereof is to provide a new developing device capable of inhibiting developer from exiting from a developer drain hole as long as the total amount of developer is not increased up to a prescribed level that necessitates drain of the developer from the developer drain hole.

Referring now to the drawings, wherein like reference numerals designate identical or corresponding parts throughout the several views thereof, and herein below, various embodiments of the present invention applied to a full-color toner image forming apparatus employing electrophotography (hereinafter simply referred to as a copier 500) are herein below described.

FIG. 1 is a diagram schematically illustrating an exemplary configuration of a copier 500 according to one embodiment of the present invention. As shown in FIG. 1, the copier 500 includes a printer unit 100 acting as an image forming system, a sheet feeding unit 200 to supply a transfer sheet serving as a recording medium to the printer unit 100, and a scanner unit 300 fixed at a top of printer unit 100 acting as an image reading unit or the like. An automatic original document feeding unit 400 is fixed at a top of scanner unit 300.

The printer unit 100 includes an image forming unit 20 constituted by four pairs of process cartridges 18Y, 18M, 18C, and 18K to form component color images of respective yellow Y, magenta M, cyan C, and black K. Respective component color symbols of Y, M, C, and K attached to numbers as suffixes indicate members or devices used in image formation of yellow, magenta, cyan, and black. The same applies hereinafter. In addition to the four pairs of process cartridges 18Y, 18M, 18C, and 18K, the printer unit 100 also includes an optical writing unit (e.g., an exposing device) 21 acting as a latent image writing unit, an intermediate transfer unit 17, a secondary transfer device 22, a pair of registration rollers 49, and a belt type fixing device 25 or the like.

The optical writing unit 21 includes a light source, not shown, a polygon mirror, an f-theta (fθ) lenses, a reflector or the like, and irradiates a surface of the photoconductive body 1 with laser light based on image data as described later in greater detail.

The process cartridges 18Y, 18M, 18C, and 18K each include a drum-shaped photoconductive body 1 acting as a latent image bearer, an electric charging unit acting as an electric charging unit that electrifies a surface of the photoconductive body 1, and a developing unit 4 acting as a developing device that develops a latent image formed on the photoconductive body 1. The process cartridges 18Y, 18M, 18C, and 18K each also include a drum cleaning unit that cleans the surface of the photoconductive body 1 as a latent image-bearer cleaning device and a neutralizing device that neutralizes the surface of the photoconductive body 1 as an electric charge removing device or the like as well.

However, since each of the process cartridges 18Y, 18M, 18C, and 18K has the similar construction to each other, the process cartridge 18Y handling yellow is herein below typically described.

That is, a surface of the photoconductive body 1Y is uniformly charged by the electric charging unit. To the surface of the photoconductive body 1Y subjected to the electric charging process in this way, a laser light beam modulated and then deflected by the optical writing unit 21 is emitted. With this, a potential generated in a surface portion of the photoconductive body 1Y decreases when the surface portion thereof is irradiated by (i.e., exposed to) the laser light beam, thereby forming an electrostatic latent image having a Y color on the surface portion of the photoconductive body 1Y. The Y color electrostatic latent image formed in this way is then rendered visible (i.e., developed) by the developing unit 4Y as a Y toner image. The Y toner image formed in this way on the photoconductive body 1Y of the Y color is then primarily transferred onto an intermediate transfer belt 110 serving as an intermediate transfer member as described later in greater detail.

Some transfer residual toner remains on the surface of the photoconductive body 1Y after the primary transfer process is executed, but is subsequently removed by the drum cleaning unit. In the process cartridge 18Y designed for the Y color, the photoconductive body 1Y cleaned by the drum cleaning unit is subjected to a neutralization process executed by the neutralizing device (i.e., the electric charge removing device). Then, the photoconductive body 1Y is uniformly charged electrically by the electric charging unit and returns to an initial condition. The above-described series of the various image formation processes is also employed similarly in the remaining process cartridges 18M, 18C, and 18K designed for remaining colors, respectively, as well.

Now, the intermediate transfer unit 17 is described herein below in greater detail with reference to FIG. 1 and applicable drawings. The intermediate transfer unit 17 includes an intermediate transfer belt 110 serving as an intermediate transfer member and a belt cleaning unit 60 serving as an intermediate transfer member cleaning member to clean the surface of the intermediate transfer belt 110 or the like. The intermediate transfer unit 17 also includes an intermediate transfer belt tensioning roller 14, a drive roller 15, a secondary transfer backup roller 16, and four primary transfer bias rollers 62Y, 62M, 62C, and 62K as well.

The intermediate transfer belt 110 is stretched and tensioned by multiple rollers including the intermediate transfer belt tensioning roller 14 to generate a certain amount of tension therein. With this, as a drive roller 15 driven by a belt drive motor, not shown, rotates, the intermediate transfer belt 110 endlessly moves (i.e., circulates) clockwise in the drawing.

Multiple primary transfer bias rollers 62Y, 62M, 62C, and 62K are disposed to almost contact an inner circumferential surface of the intermediate transfer belt 110 while receiving primary transfer bias voltages from a power supply or power supplies, not shown, respectively.

These multiple primary transfer bias rollers 62Y, 62M, 62C, and 62K, are respectively pressed against the intermediate transfer belt 110 from its inner surface toward the photoconductive bodies 1Y, 1M, 1C, and 1K, thereby forming multiple primary transfer nips therebetween. In each of these primary transfer nips, a primary transfer electric field is formed between the photoconductive body 1 and the primary transfer bias roller 62 due to influence of the primary transfer bias. The Y toner image formed on the photoconductive body 1Y designed for the Y color is primarily transferred onto the intermediate transfer belt 110 under influence of the primary transfer electric field and nip pressure generated therebetween as well. Onto the Y toner image primarily transferred and borne on the intermediate transfer belt 110 in this way, remaining M, C, and K color toner images formed on the remaining photoconductive bodies 1M, 1C, and 1K, respectively, are sequentially superimposed one after another as the primary transfer processes are executed. With this superimposition executed during the primary transfer processes, a four-color toner superimposition image as a multiple toner image (herein below simply referred to as either a four-color toner image or a full-color toner image) is formed on the intermediate transfer belt 110.

The four-color toner image serving as a multiple toner image superposed on the intermediate transfer belt 110 is then secondary transferred onto a transfer sheet acting as a recording medium, not shown, at a secondary transfer nip as described later more in detail. Some transfer residual toner generally remains on the surface of the intermediate transfer belt 110 at a portion thereof passing through the secondary transfer nip, but is removed by a belt cleaning unit 60 that holds the intermediate transfer belt 110 together with the drive roller 15 disposed on the left side in the drawing therebetween.

Now, a secondary transfer device 22 is herein below described more in detail with reference to FIG. 1. Below the intermediate transfer unit 17 in the drawing, the secondary transfer device 22 is disposed while including a pair of tensioning rollers 23 and a sheet conveying belt 24 tensioned by the pair of tensioning rollers 23. The sheet conveying belt 24 endlessly moves counterclockwise in the drawing as at least one of the tensioning rollers 23 is driven and rotated.

Out of the two tensioning rollers 23, one of those, i.e., an upstream tensioning roller 23 disposed upstream in a transfer sheet conveying direction holds the intermediate transfer belt 110 and the sheet conveying belt 24 as well together with a secondary transfer backup roller 16 included in the intermediate transfer unit 17 therebetween. Due to such clamping (i.e., holding), a secondary transfer nip is formed between the sheet conveying belt 24 of the secondary transfer device 22 and the intermediate transfer belt 110 of the intermediate transfer unit 17 engaging with the sheet conveying belt 24 of the secondary transfer device 22 therein.

Here, a secondary transfer bias having a reverse polarity to that of toner is applied to the above-described one of upstream tensioning rollers 23 from a power supply, not shown. Due to application of the secondary transfer bias voltage, in the secondary transfer nip, a secondary transfer electric field to electrostatically move the four-color toner image borne on the intermediate transfer belt 110 toward the above-described upstream roller 23 therefrom is formed. Onto a transfer sheet sent up to the secondary transfer nip by the below described pair of registration rollers 49 in synchronism with the four-color toner image borne on the intermediate transfer belt 110, the four-color toner image is secondarily transferred under the second transfer electric field and the nip pressure as well. Here, instead of the above-described secondary transfer system, in which the secondary transfer bias is applied to the one of upstream tensioning rollers 23, a charger brought in non-contact with the transfer sheet may be employed to electrically charge the transfer sheet as well.

In a sheet feeding unit 200 disposed at the bottom of the body of the copier 500, multiple sheet feeding cassettes 44 each capable of accommodating multiple transfer sheets in a bundle state are vertically stacked at multiple stages, respectively. In each of the sheet feeding cassettes 44, a sheet feeding roller 42 is pressed against a topmost transfer sheet of the multiple transfer sheets in a bundle state. Hence, as the sheet feeding roller 42 rotates, the top most transfer sheet is launched into a sheet feeding path 48.

A collective sheet feeding path 46 and 48 sequentially receiving the transfer sheet from one of the sheet feeding cassettes 44 includes multiple pair of sheet conveying rollers 47 and a pair of registration rollers 49 near the end of the collective sheet feeding path 46 and 48. Hence, the collective sheet feeding path 46 and 48 conveys the transfer sheet toward the pair of registration rollers 49. The transfer sheet conveyed toward the pair of registration rollers 49 is then sandwiched between the pair of registration rollers 49.

Meanwhile, in the intermediate transfer unit 17, the four-color toner image formed and borne on the intermediate transfer belt 110 enters the secondary transfer nip as the intermediate transfer belt 110 endlessly moves. Then, the pair of registration rollers 49 sends the transfer sheet sandwiched between the pair of registration rollers at a time when the transfer sheet can synchronize with and tightly adhere to the four-color toner image borne on the intermediate transfer belt 110 in the secondary transfer nip.

With this, in the secondary transfer nip, the four-color toner image borne on the intermediate transfer belt 110 closely adheres to the transfer sheet. That is, the four-color toner image is secondarily transferred at the time onto the transfer sheet as a full-color toner image by contrast with a white color of the transfer sheet (i.e., a blank sheet). The transfer sheet with the full-color toner image formed thereon in this way then exits from the secondary transfer nip and is further sent into the fixing device 25 while staying on the sheet conveying belt 24 as the sheet conveying belt 24 endlessly moves.

The fixing unit 25 includes a belt unit having a fixing belt 26 tensioned and endlessly moved (i.e., circulated) by two rollers and a pressing roller 27 pressed against one of the two rollers of the belt unit. The fixing belt 26 and the pressing roller 27 contact each other while collectively forming a fixing nip therebetween to pinch the transfer sheet here upon received it from the sheet conveying belt 24.

Out of these two rollers in the belt unit, the roller pressed by the pressing roller 27 accommodates a heat source, not shown, to generate heat thereby heating the fixing belt 26. The fixing belt 26 heated in this way then heats the transfer sheet sandwiched and pinched at the fixing nip between the fixing belt 26 and the pressing roller 27. Under the heat and nip pressure generated between the fixing belt 26 and the pressing roller 27, the full-color toner image is ultimately fixed onto the transfer sheet.

The transfer sheet subjected to the fixing process of the fixing device 25 is stacked on a sheet stack tray 57 disposed outside of a left side plate of the body of the printer unit 100 in the drawing along a sheet ejection path. Otherwise, to additionally form a toner image on the other side of it, the transfer sheet is returned to the above-described secondary transfer nip along a sheet refeeding path. That is, one of the above-described sheet conveyance methods (i.e., one of the sheet ejection path and the sheet refeeding path) is selected.

When one or more copies are taken from one or more original documents, not shown, a bunch of sheet type original documents, for example, is placed on an original document table 30 included in the automatic original document feeding unit 400. However, when a one-side bound original document, in which multiple original documents are bound like a book, is used, it is directly placed onto a contact glass 32.

Prior to this setting of the one-side bound original document onto the contact glass 32, the automatic original document feeding unit 400 is opened from the body of the copier to expose the contact glass 32 of the scanner unit 300. Subsequently, the automatic original document feeding unit 400 is closed after that and the one-side bound original document is thereby depressed by the automatic original document feeding unit 400. When a copy start switch, not shown, is depressed after the original document has been set thereunto, the scanner unit 300 starts reading the original document.

By contrast, when a sheet type original document is used and set onto the automatic original document feeding unit 400, the automatic original document feeding unit 400 automatically moves the original document sheet up to the contact glass 32 prior to the reading process of the scanner unit 300 to read the original document.

In the original document reading process, first of all, first and second carriages 33 and 34 start running, while a light source provided in the first carriage 33 emits light therefrom the at the same time. At the same time, light reflected from a surface of the original document is reflected by a mirror provided in the second carriage 34 thereby entering a reading sensor 36 after passing through an imaging lens 35 as well. The reading sensor 36 then generates image information based on incident light entering the reading sensor 36 in this way.

In parallel to the above-described original document reading process, various devices included in each of the process cartridges 18Y, 18M, 18C, and 18K, the intermediate transfer unit 17, the secondary transfer device 22, and the fixing device 25 timely start driving. That is, based on the image information generated by the reading sensor 36, the optical writing unit 21 is controlled to form Y, M, C, and K toner images on the respective photoconductive bodies 1Y, 1M, 1C, and 1K. As described earlier, these toner images lead to the four-color toner image when transferred and superimposed on the intermediate transfer belt 110 later on.

Meanwhile, almost at the same time when the original document reading process starts, the sheet feeding process immediately starts in the sheet feeding unit 200. During the sheet feeding process, one of the sheet feeding rollers 42*b* is selectively rotated to launch a transfer sheet from one of the sheet feeding cassettes 44 stacked in the multiple stages in a sheet bank 43, respectively. The transfer sheets sent out in this way are separated by a separation roller 45 one by one thereby entering the sheet feeding path 46. The transfer sheet is then further conveyed by the pair of sheet conveying rollers 47 toward the secondary transfer nip.

Instead of the above-described sheet feeding executed from such a sheet feeding cassette 44, manual sheet feeding executed from a manual sheet feeding tray 51 may be employed sometimes. In such a situation, after a manual sheet feeding roller 50 is selectively rotated, thereby sending out transfer sheets stacked on the manual sheet feeding tray 51, a manual sheet feed separation roller 52 separates the transfer sheets one at a time, and further feeds it into a manual sheet feeding path 53 provided in the printer unit 100 as shown in FIG. 1.

When a multicolor toner image composed of two or more colors is formed, the intermediate transfer belt 110 is suspended and tensioned in a posture with its upper tensioned and stretched surface being almost laterally extended while contacting all of the photoconductive bodies 1Y, 1M, 1C, and 1K in the copier 500. By contrast, when a monochrome image is to be formed only using K toner, the intermediate transfer belt 110 is caused by a prescribed mechanism, not shown, to have a posture inclined to a lower left in the drawing to separate the upper tensioned and stretched surface of the intermediate transfer belt 110 from the remaining photoconductive bodies 1Y, 1M, and 1C.

At the same time, out of the photoconductive bodies 1Y, 1M, 1C, and 1K only the photoconductive body 1K designed for a K color is rotated counterclockwise in the drawing to only form a K toner image. At this moment, not only driving of the photoconductive bodies 1Y, 1M, and 1C, but also that of the developing units 4Y, 4M, and 4C are stopped as well to prevent unnecessary wear and tear of the photoconductive bodies 1Y, 1M, and 1C, various parts of the developing units 4Y, 4M, and 4C, and two-component developer (hereinafter simply referred to as developer) including toner and magnetic carrier (hereinafter simply referred to as carrier) stored in the developing units 4Y, 4M, and 4C as well.

The copier 500 includes a control unit, not shown, acting as a control device mainly composed of a CPU that controls each of devices included in the copier 500 or the like. The copier 500 also includes an operation display unit, not shown, mainly composed of an LCD (Liquid Crystal Display) and various types of keypad buttons or the like as well.

Hence, an operator is enabled to select one of the below described three single-sided print modes only to form an image on one side of the transfer sheet, for example, by providing a key input to the operation display unit and thereby sending an instruction or instructions to the control unit. That is, the three one-sided print modes include a direct sheet ejection mode, an inverted sheet ejection mode, and an inverted curl removing sheet ejection mode, for example.

Figure 2:
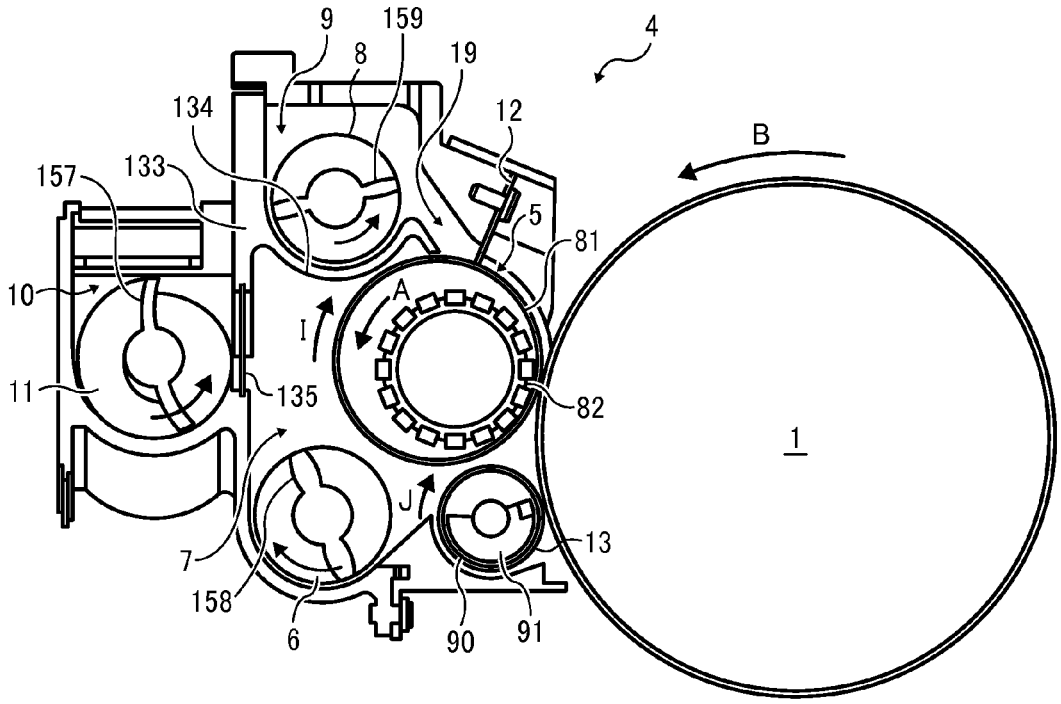
FIG. 2 is an enlarged view illustrating an exemplary configuration of a developing unit and a photoconductive body collectively attached to each of multiple process cartridges employed in the copier of FIG. 1 according to the first embodiment of the present invention.

FIG. 2 is an enlarged view illustrating an exemplary configuration of the developing unit 4 and photoconductive body 1 installed in each of the process cartridges 18Y, 18M, 18C, and 18K included in the copier 500 according to one embodiment of the present invention. Since these four process cartridges 18Y, 18M, 18C, and 18K each include almost the similar configuration except for component color of toner handled, suffixes of Y, M, C, and K to be attached to a reference number or numbers or the like are omitted in the drawing of FIG. 2.

As shown in FIG. 2, the process cartridge 18 is constituted by integrating a photoconductive body 1 serving as a latent image bearer, an electric charging unit, not shown, a developing unit 4 (i.e., a developing station), and a photoconductive body cleaning unit, not shown, with each other. A premix developing system (i.e., a developing unit 4, in which carrier is supplied to and discharged from developer from time to time) is employed. The photoconductive body 1 acting as a latent image bearer employs an organic photoconductive body negatively charged electrically, and is driven and rotated by a revolution driving mechanism, not shown, counterclockwise as shown by arrow B in the drawing.

Here, Since the developing unit 4 employs the premix developing system in this embodiment as described above, developer G including T toner blended with fresh carrier C is supplied to the developing unit 4 from the developer cartridge, not shown, from time to time. At the same time, when the above-described developer G is supplied, the developer G including degraded carrier C is discharged toward an exhaust developer storage container, not shown, placed outside of the developing unit 4 as well. That is, the developer cartridge accommodates developer G (i.e., toner T & carrier C) to be supplied to an interior of the developing unit 4. The developer cartridge serving as a toner cartridge that supplies brand new toner T to the developing unit 4 and a supplying device that also supplies new carrier C to the developing unit 4 as well. For example, a mixing rate of the toner T to the carrier C (i.e., toner density) in the developer G stored in the developer cartridge is set relatively higher in this embodiment.

As shown in FIG. 2, the photoconductive body 1 rotates counterclockwise as shown by arrow B in the drawing with its surface electrified by the electric charging unit, not shown. On the surface of the photoconductive body 1 charged in this way, an electrostatic latent image is formed as laser light is irradiated thereto by an optical writing unit (e.g., an exposing device), not shown. Then, toner is supplied to the electrostatic latent image from the developing unit 4 thereby forming a toner image thereon.

The developing unit 4 stores developer including carrier and toner and includes a developing roller 5 acting as a developer bearer that supplies toner and renders a latent image borne on a surface of the photoconductive body 1 visible while conveying the developer thereto in a direction as shown by arrow I in the drawing. The developing roller 5 includes a developing sleeve 81 acting as a rotatable developer bearer and a magnetic roller 82 having more than one magnetic pole rotatable in a direction as shown by arrow A in the drawing to act as a first magnetic field generation device. At a position below the developing roller 5, downstream of the photoconductive body 1 in a surface movement direction thereof, and adjacent to both the developing roller 5 and the photoconductive body 1, there is provided a carrier collecting roller unit 13 acting as a carrier collection device. Similar to the developing roller 5, the carrier collecting roller unit 13 also includes a carrier collection sleeve 90 acting as a rotatable carrier supporting device and a carrier collection magnetic roller 91 having multiple fixed poles therein to act as a second magnetic field generating device (i.e., a carrier collection magnetic field generating device). Hence, some carrier adhered to the photoconductive body 1 is collected by the carrier collecting roller unit 13 and is sent back to the developing unit 4 under magnetic force of the carrier collection magnetic roller 91 as the carrier collection sleeve 90 rotates in a direction as shown by arrow J in the drawing.

The developing unit 4 also includes a developer supply screw 8 (i.e., a third developer conveyor) acting as a developer supply conveyor to convey the developer toward a back side of the drawing of FIG. 2 (hereafter simply referred to as a rear side of FIG. 2) in an axial direction of the developing roller 5 while supplying the developer to the developing roller 5. A doctor blade 12 is also disposed downstream of an opposing section 19 of the developing roller 5 in a developer conveying direction as shown by arrow I (hereinafter simply referred to as downstream), which is opposed to the developer supply screw 8. The doctor blade 12 acts as a developer regulation device to regulate developer supplied to the developing roller 5 to have a prescribed thickness suitable for development. In addition, a collected developer conveyance channel 7 is provided downstream of a developing region of the developing roller 5, which faces the photoconductive body 1, while facing the developing roller 5 to collect developer not spent during a developing process thereby dropping from the surface of the developing roller 5 after passing through the developing region.

In the collected developer conveyance channel 7, a developer collection screw 6 (i.e., a first developer conveyor) having a spiral-shaped blade mounted on its rotary shaft parallel to an axis of the developing roller 5 is provided as a collected developer conveyor. That is, the developer collection screw 6 conveys collected developer in the same direction as the developer supply screw 8, which is parallel to the axis of the developing roller 5. The developer supply conveyance channel 9 with the developer supply screw 8 is disposed almost above the developing roller 5 vertically side by side. By contrast, the collected developer conveyance channel 7 with the developer collection screw 6 is disposed almost below the developing roller 5 vertically side by side as well.

Further, a developer stiffing conveyance channel 10 is also installed in the developing unit 4 and is extended in a direction parallel to both the developer supply conveyance channel 9 and the collected developer conveyance channel 7 as well in a horizontal plane. The developer stirring conveyance channel 10 is inclined to have substantially the same height as the collected developer conveyance channel 7 at the rear side of FIG. 2 and the same height as the supply conveyance channel 9 as well at the front side in the drawing of FIG. 2 (hereinafter simply referred to as a front side of FIG. 2). The developer stiffing conveyance channel 10 includes a developer stirring screw 11 (i.e., a second developer conveyor) inclined from the axis of the developing roller 5 with a spiral blade 157 mounted on its rotary shaft to conveyance the developer while stiffing thereof toward the front side of FIG. 2. That is, the developer stiffing screw 11 conveyance the developer while stirring thereof in a direction opposite a direction in which the developer supply screw 8 conveys as described earlier.

A first partition wall 133 is also provided as a first partition to separate the developer supply conveyance channel 9 from the developer stiffing conveyance channel 10 laterally (i.e., horizontally) disposed side by side. The first partition wall 133 includes an opening at its front side in the drawing of FIG. 2 to communicate the developer supply conveyance channel 9 with the developer stirring conveyance channel 10. A second partition wall 134 is also provided as a second partition to separate the collected developer conveyance channel 7 from the developer supply conveyance channel 9 vertically disposed side by side. The second partition wall 134 also includes an opening (i.e., the excessive developer opening) at its rear side in the drawing of FIG. 2 to communicate the developer supply conveyance channel 9 with the collected developer conveyance channel 7. A third partition wall 135 is also provided as a third partition to separate the developer stirring conveyance channel 10 from the collected developer conveyance channel 7 laterally disposed side by side. The third partition wall 135 also includes an opening at its rear side in the drawing of FIG. 2 to communicate the developer stiffing conveyance channel 10 with the collected developer conveyance channel 7.

Each of the developer supply screw 8, the developer collection screw 6, and the developer stiffing screw 11 respectively acting as developer conveyors is made of either resin or metal. Respective diameters of the developer supply screw 8, the developer collection screw 6, and the developer stirring screw 11 are about 26 mm, about 26 mm, and about 30 mm. The developer supply screw 8 is two-line winding type with a screw pitch of about 54 mm. The developer collection screw 6 is also a two-line winding type with a screw pitch of about 36 mm. The developer stiffing screw 11 is also a two-line winding type with a screw pitch of about 54 mm. The number of revolutions of each of the developer supply screw 8, the developer collection screw 6, and the developer stirring screw 11 is set to about 600 rpm.

Here, developer borne on the developing roller 5 is made into a thin-layer by a doctor blade 12 made of stainless steel, and is then conveyed to the developing region opposed to the photoconductive body 1 thereby developing a latent image borne on the photoconductive body 1. Here, a diameter of the developing roller 5 is about 40 mm. A gap between the doctor blade 12 and the photoconductive body 1 is set to about 0.3 mm. The developer not spent during a developing process is collected thereafter into the collected developer conveyance channel 7, and is further conveyed toward the rear side in the drawing of FIG. 2. The developer is then transferred into the developer stirring conveyance channel 10 from the opening of the third partition wall 135, which is opposed to a non-image area on the surface of the photoconductive body 1. Further, almost above the opening of the second partition wall 134, which is located on the downstream in the developer supply conveyance channel 9, a developer supply mouth 141 is disposed so that developer G is supplied onto the developer supply conveyance channel 9 from above as described later in detail with reference to FIG. 3.

Figure 3:
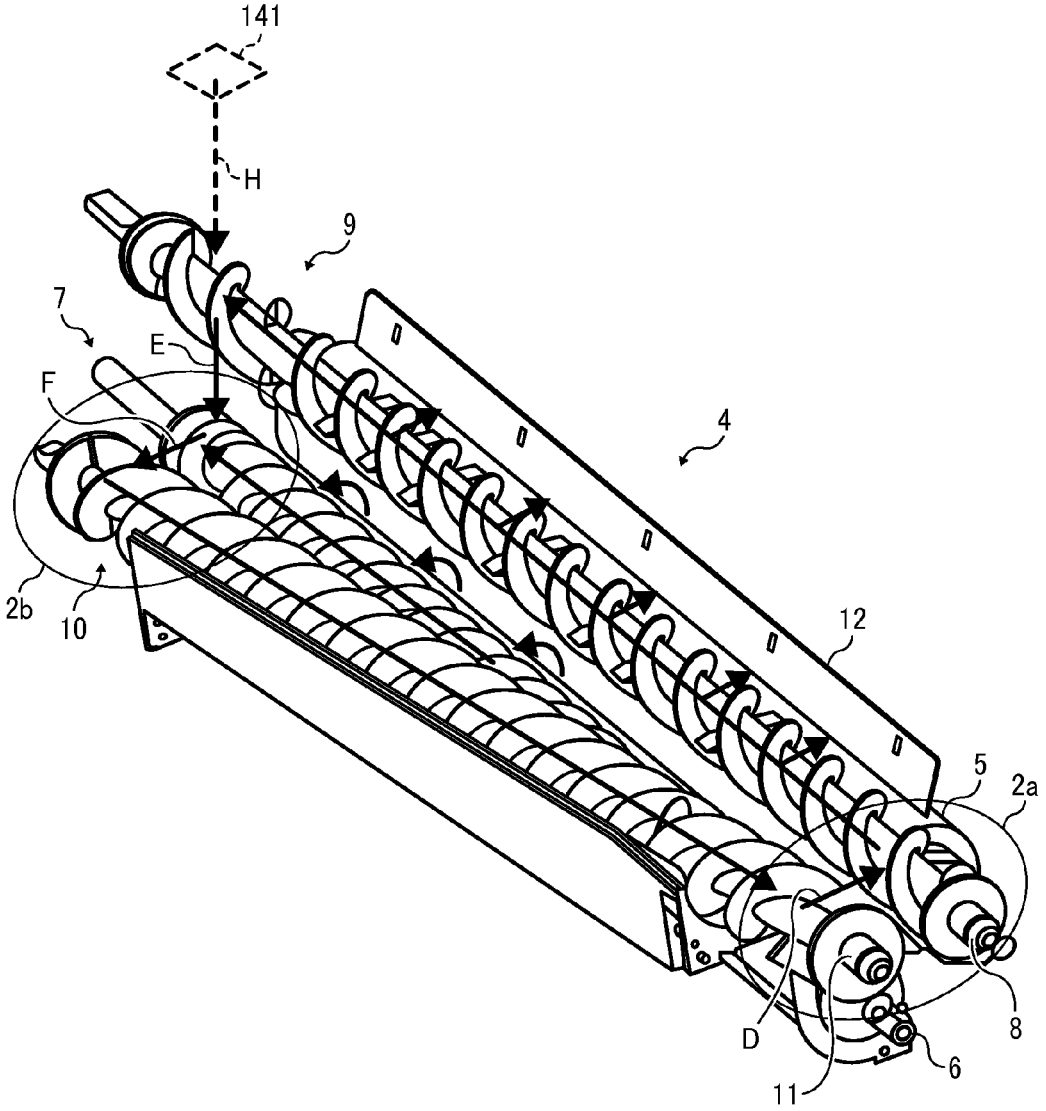
FIG. 3 is a transparent perspective view partially illustrating the developing unit with a developer conveyance channel and an exemplary flow of developer flowing through the developer conveyance channel according to the first embodiment of the present invention.

Now, exemplary circulation of the developer occurring in these three developer conveyance channels is described with reference to FIG. 3 and applicable drawings. FIG. 3 is a perspective view partially illustrating the developing unit 4 and exemplary flow of developer occurring in the developer conveyance channels. That is, each of arrows in the drawing represents a moving direction of the developer. As shown there, in the developer supply conveyance channel 9 that receives supply of the developer from the developer stiffing conveyance channel 10, the developer is brought in contact with and accordingly supplied to the developing roller 5 while traveling in a prescribed direction. Here, excessive developer not supplied to the developing roller 5 and traveling up to a downstream edge of the developer supply conveyance channel 9 is transferred (or delivered) to the collected developer conveyance channel 7 as shown by arrow E in FIG. 3 from an excessive developer opening (i.e., the developer drop hole 142) formed in the second partition wall 134 of as shown in FIG. 2.

Meanwhile, the developer supplied and used in a developing process by the developing roller 5 in the developing region is separated and drops therefrom and is delivered to the collected developer conveyance channel 7 (i.e., the developer collection screw 6) as well. The developer passed from the developing roller 5 to the collected developer conveyance channel 7 in this way is further conveyed up to a downstream edge of the collected developer conveyance channel 7 by the developer collection screw 6. Subsequently, the collected developer is transferred (or delivered) to the developer stiffing conveyance channel 10 (i.e., transferred (or delivered) to the developer stiffing screw 11) from a collection opening formed in the third partition wall 135 as shown by arrow F in FIG. 3.

Hence, in the developer stirring conveyance channel 10, the excessive developer supplied from the developer supply conveyance channel 9, the collected developer collected by the collected developer conveyance channel 7, and the developer G supplied from the developer supply mouth 141 as shown by arrow H in FIG. 3 are stirred. These developer particles stirred in this way are then conveyed to a position located downstream in a developer conveying direction in which developer is conveyed by the developer stiffing screw 11, which is upstream in a developer conveying direction in which developer is conveyed by the developer supply screw 8. These developer particles stirred in this way are then supplied to the developer supply conveyance channel 9 at the position from the supply opening formed in the first partition wall 133 in a direction as shown by arrow D in FIG. 3. Further, below the developer stiffing conveyance channel 10, a toner density sensor, not shown, mainly composed of a permeability detection magnetic sensor is disposed. A toner supply controller, not shown, provided in the copier controls supplying of toner from the developer cartridge, not shown.

Since the developing unit 4 employs the developer supply conveyance channel 9 and the collected developer conveyance channel 7, and accordingly executes developer supply and collection by using a different developer conveyance channel from each other, respectively, as shown in FIG. 3, developer used in the developing process does not enter the supply conveyance channel 9. Because of this, increasingly decreasing in toner density of developer supplied to the developing roller 5 as the developer supply conveyance channel 9 goes downstream can be inhibited. Further, since the developing unit 4 employs the collected developer conveyance channel 17 and the developer stirring conveyance channel 10 separately thereby stiffing and collecting developer by using a different developer conveyance channel from each other, developer used in the developing process does not fall into the developer stiffing conveyance channel 10. Hence, developer is adequately stirred and is thereby supplied to the supply conveyance channel 9, insufficient stiffing of developer supplied to the supply conveyance channel 9 can be likely reduced. In this way, since decrease in toner density of the developer in the developer supply conveyance channel 9 and poor stiffing of the developer therein as well can be suppressed at the same time, optical density of a developed image can be constant.

Here, in a typical developing unit 4 employing two-component developer as in the developing unit 4 of this embodiment, more than one screw is employed to convey the two-component developer. Accordingly, a developer transfer section is installed to transfer the developer between the screws thereby circulating the developer in the developing unit 4. The developer transfer section is generally located at a place at which the developer ordinarily gathers in the developing unit 4 to effectively circulate the developer therein. Because of this, since a height of the developer extremely obviously varies at the developer transfer section as an amount of overall developer existing over the entire developer conveyance channel increases or decreases, a developer drain hole is provided at the developer transfer section of the developing unit 4 to discharge degraded developer (e.g., carrier) to an outside of the developing unit 4 when the height of the developer obviously increases.

When these multiple screws are positioned laterally side by side (i.e., in a horizontal direction) at the developer transfer section of the developing unit 4, to effectively transfer developer from an upstream screw to a downstream screw, the downstream screw is located on a developer coming side of the upstream screw. That is, the downstream screw is provided on a side on which rotation of the upstream screw is coming from a bottom side to an upper side thereof. When it is employed in such a developer transfer section in the developing unit 4, the developer drain hole is located in a wall of the downstream developer conveyance channel having the downstream screw on the opposite side to the upstream screw, in which the greatest amount of developer gathers. Hence, the developer can be effectively discharged when the height thereof increases.

However, the above-described configuration may cause the below described problem. That is, in the developer transfer section of the developing unit 4 in which developer is laterally transferred from the upstream screw to the downstream screw, a lateral flow of the developer occurs. Subsequently, this flow gains momentum due to some reason, and accordingly a developer flow rises from below the bottom of the screw toward the developer drain hole along a wall that constitutes the downstream developer conveyance channel accommodating the downstream screw. The above-described developer flow either increases or decreases depending on a rotational position of each of the spiral blades 158 and 157 of these upstream and downstream screws. That is, when each of the spiral blades 157 and 158 is positioned to more easily laterally send the developer, the developer jumps up from below the bottom of the screw along the wall of the downstream developer conveyance channel. Consequently, a surface of the developer rises at the developer drain hole provided at a position opposed to the opening of the developer transfer section. Because of this, even though the total amount of developer stored in the developing unit 4 does not reach a prescribed level that necessitates discharging of it, the developer is forcibly discharged from the developer drain hole as a result.

The above-described phenomenon noticeably occurs when the amount of developer stored in the developing unit 4 is either an appropriate level or less than the level thereof. Because of this, even though the amount of developer stored in the developing unit 4 is either an appropriate level or less than that, since the developer is discharged from the developer drain hole, the developer stored in the developing unit 4 falls below a required amount therefor, developer supply to a latent image bearer such as a drum-shaped photoconductive body, etc., likely becomes unstable. Consequently, when the developer supply to the latent image bearer becomes unstable, an abnormal image, such as drop out, etc., occurs as a result.

To effectively transfer developer in the above-described developer transfer section of the developing unit 4, a known system employs a prescribed device in the developer transfer section of the upstream screw. That is, for example, a paddle shape (hereinafter simply referred to as a paddle) is employed in the developer transfer section of the upstream screw to apply force to the developer in a rotational direction of the upstream screw. However, when the paddle is employed in this way, the developer more prominently jumps up as a result. Accordingly, even though the amount of developer stored in the developing unit 4 does not increase up to a prescribed level that necessitates discharging of the developer, a discharging amount of developer further increases as a problem. Consequently, the developer stored in the developing unit 4 falls below the required amount therefor again, and accordingly developer supply to the latent image bearer such as a drum-shaped photoconductive body, etc., more likely becomes unstable. When the developer supply to the latent image bearer becomes unstable, an abnormal image, such as occurrence of drop out, etc., more likely occurs as a result.

Here, the below described known system attempts to inhibit the developer from jumping up generally caused by moving momentum thereof or rotational force of the upstream screw by preventing the developer from discharging from the developer drain hole even when the amount of developer stored in the developing unit 4 does not increase up to a prescribed level that necessitates discharging of the developer. That is, a prescribed member capable of preventing developer flying above the downstream screw from entering the developer drain hole is placed above the downstream screw. However, the above-described system cannot suppress occurrence of erroneous developer discharge caused by the above-described jumping up thereof from below the downstream screw.

Now, the developing unit 4 having an unique system, an operation, and advantages capable of reducing erroneous discharging of developer generally caused by jumping of the developer is herein below described with reference to applicable drawings according to various embodiments of the present invention. In each of the various embodiments of the present invention, a system, in which a paddle is attached to a rotary shaft of a developer collection screw 6 in a developer transfer section of an upstream screw, in which the developer is laterally transferred thereby likely prominently causing the above-described phenomenon, is herein below described. However, the present invention is not limited to such a system, and can be applied to a system, in which the paddle is not attached to the rotary shaft of the developer collection screw 6. In addition, the present invention can be also applied to a system equipped with two screws, so that developer supply, developer collection, and developer stiffing are executed by one of these two screws while executing developer stirring by using the other one of these two screws.

Figure 4:
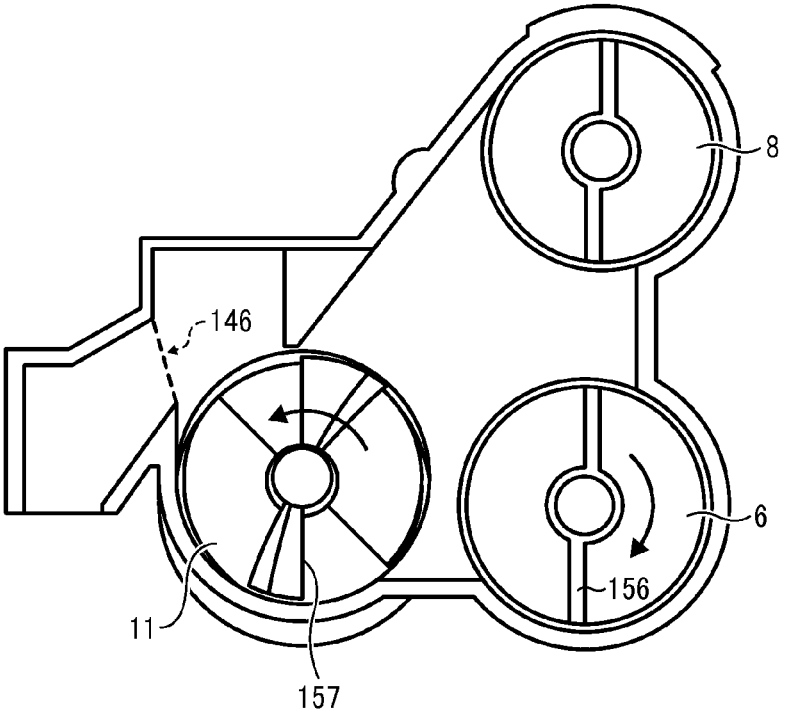
FIG. 4 is a cross-sectional view illustrating a developer transfer section in the developing unit, in which developer is laterally (i.e., horizontally) delivered from a developer collection screw that rotates in a prescribed direction as shown by thin arrow (herein below the same) to a developer stiffing screw in a prescribed direction as shown by relatively fat arrow (herein below the same), which is taken from a front side in FIG. 2 according to the first embodiment of the present invention.

Herein below, various embodiments of the present invention are described with reference to applicable drawings. First of all, a first embodiment of the present invention is described with reference to FIG. 3 and applicable drawings as well. That is, as shown in FIG. 3, two developer transfer sections are provided at two locations in the developer conveyance channels in the developing unit 4 according to this embodiment. Specifically, a second developer transfer section 2*a* is provided to transfer developer from the developer stirring screw 11 to the developer supply screw 8. A first developer transfer section 2*b* is also provided to transfer developer from the developer collection screw 6 to the developer stirring screw 11 as well. In each of these developer transfer sections, a height of developer extremely prominently increases and decreases in relation to a change in overall amount of developer existing in the entire developer conveyance channels. In the above-described second developer transfer section 2*a* (2*b*), in which developer is transferred from the developer collection screw 6 to the developer stirring screw 11, an developer drain hole 146 is provided to discharge developer to an outside of the developing unit 4 as shown in FIG. 4. That is FIG. 4 is a cross-sectional view illustrating the first developer transfer section 2*b*, in which developer is transferred from the developer collection screw 6 to the developer stirring screw 11, which is taken from a front side in FIG. 2.

As described earlier, in the rear side of FIG. 2, since the collected developer conveyance channel 7 and the developer stirring conveyance channel 10 have substantially the same height as shown by the cross-sectional view of FIG. 4, the collected developer conveyance channel 7 and the developer stirring conveyance channel 10 are almost laterally (i.e., horizontally) disposed side by side. In addition, in the developing unit 4, the developer collection screw 6 is positioned upstream while the developer stirring screw 11, downstream, respectively. Hence, as shown in FIG. 4, the developer collection screw 6 rotates clockwise, and accordingly the developer stiffing screw 11 is disposed at a developer drawing side of the developer collection screw 6. That is, the developer stirring screw 11 is disposed at a position at which rotation of an upstream screw (i.e., the developer collection screw 6) is directed from the bottom to the top thereof. In the first developer transfer section 2*b* of the developer collection screw 6 (i.e., a portion of the developer collection screw 6 opposed to the opening formed in the third partition wall 135), a paddle 156 is provided to more effectively laterally convey the developer toward the developer stirring screw 11. The developer drain hole 146 is provided in a side wall of a developer conveyance channel, which is located on an opposite side of the developer stiffing screw 11 to the developer collection screw 6, in which the greatest amount of developer gathers.

In the first developer transfer section 2*b*, as shown in FIG. 4, a lateral developer flow occurs due to rotation of the developer collection screw 6 from the developer collection screw 6 to the developer stirring screw 11. Subsequently, the developer flow almost jumps up from below the developer stirring screw 11 along a wall of the developer stirring conveyance channel 10, so that a surface of the developer located at the developer drain hole 146 provided in the wall is lifted up from below. When the screw 6 rotates at high speed (i.e., the large number of revolutions) as in this embodiment, since the developer intensively flows laterally from the developer collection screw 6, the developer flow jumping up along the wall of the developer stiffing conveyance channel 10 from below the developer stiffing screw 11 becomes more intensive. However, in a conventional system, rotational phases of the developer collection screw 6 and the developer stiffing screw 11 are not intentionally fixed (i.e., not fixed and fixed and synchronized with each other).

Figure 5:
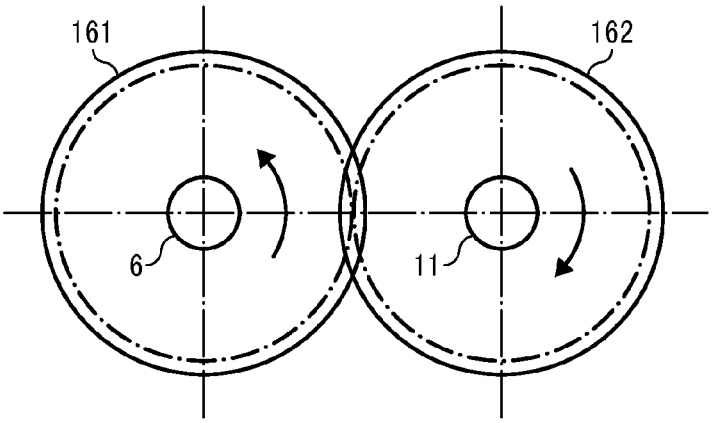
FIG. 5 PRIOR ART
FIG. 5 is a diagram illustrating a conventional drive coupling system employed in the first embodiment of the present invention to couple the developer collection screw with the developer stiffing screw via multiple gears.

In addition, since the developer collection screw 6 and the developer stiffing screw 11 are aligned laterally (i.e., laterally disposed side by side) near the first developer transfer section 2*b* of the developing unit 4, driving force is conventionally commonly conveyed therebetween by engaging a collection driving gear 161 provided at one end of the developer collection screw 6 with a stirring drive gear 162 provided at one end of the developer stirring screw 11 as shown in FIG. 5. In such a situation, when one of the driving gears always meshes with the other one of driving gears via the same teeth, eccentric wear occurs therein thereby increasing vibration during rotation of these developer collection screw 6 and the developer stiffing screw 11. To prevent such a problem, the number of teeth is deliberately differentiated from that of the other teeth to shift a meshing phase of one of the gears from the other one of the gears as these gears rotate so that the same gear tooth do not always mesh with each other. As a result, a positional relation between spiral blades 158 and 157 of the developer collection screw 6 and the developer stiffing screw 11 is changed as each of these screws 6 and 11 rotates.

However, when the positional relation between the spiral blades 158 and 157 of the developer collection screw 6 and the developer stiffing screw 11 is changed, intensity of the developer flow laterally caused by rotation of the developer collection screw 6 from the developer collection screw 6 to the developer stirring screw 11 also changes as well. Consequently, intensity of the developer flow jumping up from below the developer stiffing screw 11 along the wall of the developer stirring conveyance channel 10 also changes as specifically described below.

Figure 6:
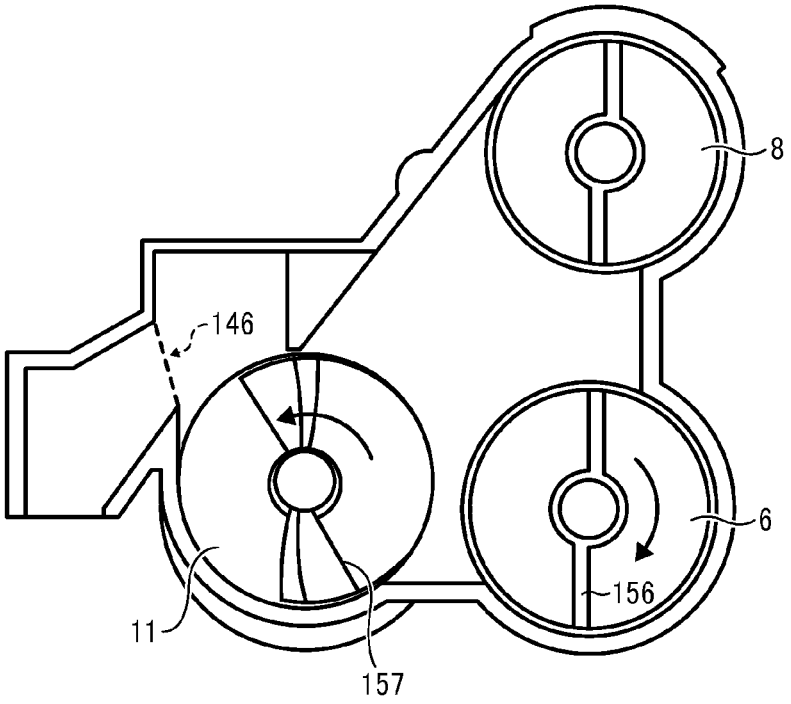
FIG. 6 is a cross-sectional view illustrating the developing unit when pushing out force of the developer collection screw applied to the developer toward the developer stirring screw therefrom grows while a minimum amount of the developer is discharged from a developer drain hole, which is taken again from the front side in FIG. 2, according to the first embodiment of the present invention.

That is, when the paddle 156 provided in the first developer transfer section 2*b* of the developer collection screw 6 comes to a vertically downward position as shown in FIG. 6, the paddle 156 of the developer collection screw 6 generates a maximum push out force directed toward the developer stirring screw 11.

Figure 7:
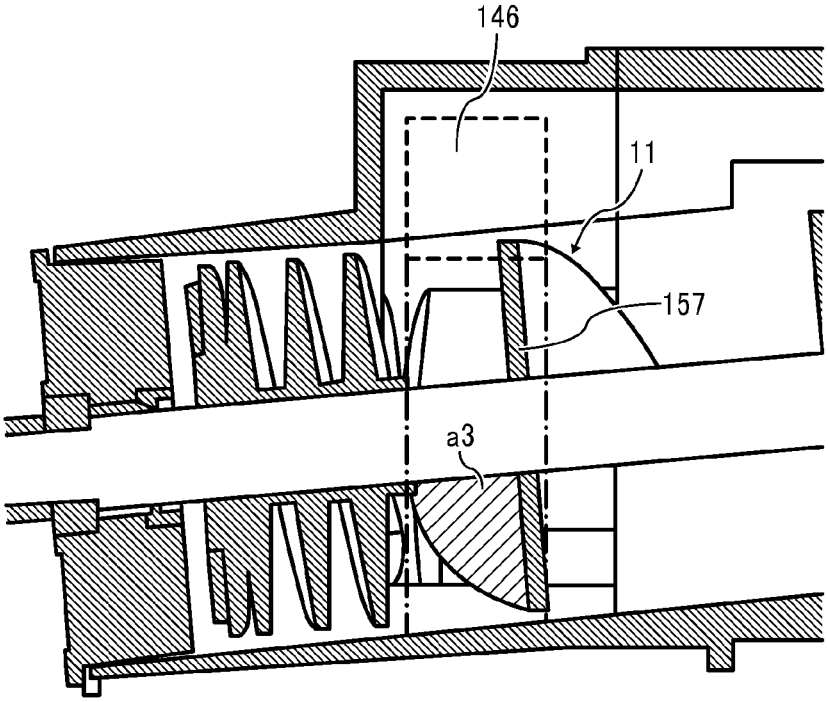
FIG. 7 is a cross-sectional view illustrating the developing unit when pushing out force of the developer collection screw applied to the developer toward the developer stirring screw therefrom grows while a minimum amount of the developer is discharged from a developer drain hole, which is taken in a direction parallel to a rotary shaft of the developer stiffing screw, according to the first embodiment of the present invention.

In such a situation, in which the paddle 156 of the developer collection screw 6 generates the maximum push out force directed toward the developer stiffing screw 11, when it is viewed at a position of the developer stiffing screw 11 opposed to the developer drain hole 146 in the first developer transfer section 2*b* from the side wall having the developer drain hole 146 toward the developer collection screw 6, the developer stiffing screw 11 may be positioned to maximize a region a3 of a lower spiral blade 157 thereof located below the rotary shaft thereof to hide the developer collection screw 6 as shown in FIG. 7. That is, the spiral blade 157 of the developer stiffing screw 11 extremely impedes the lateral developer flow generated from the developer collection screw 6 to the developer stirring screw 11. Hence, as shown in FIG. 6, the developer flow jumping up from below the developer stirring screw 11 along the wall of the developer stirring conveyance channel 10 is extremely weakened. That is, the developer is consequently conditioned to be extremely hardly discharged from the developer drain hole 146.

Figure 8:
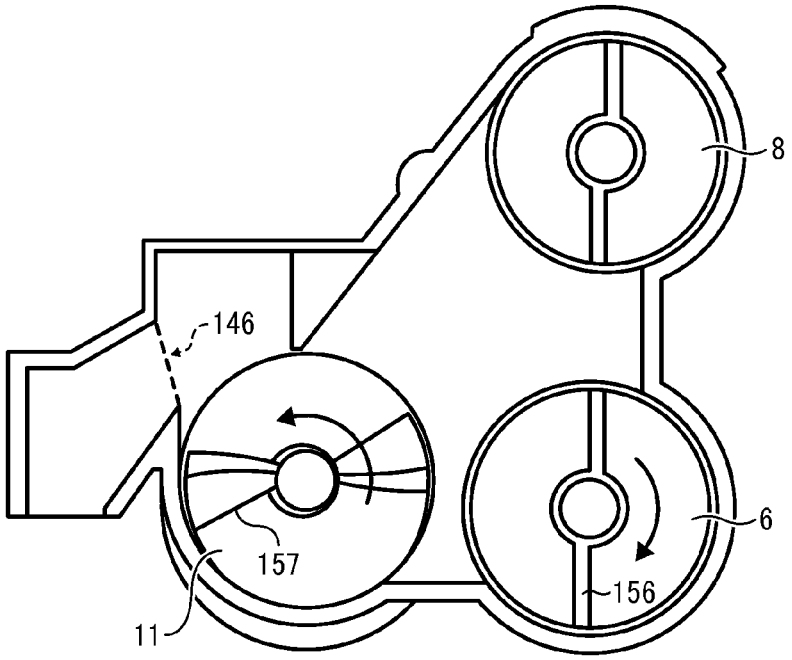
FIG. 8 is a vertical cross-sectional view illustrating the developing unit of the developing unit when pushing out force of the developer collection screw applied to the developer toward the developer stiffing screw therefrom grows while a maximum amount of the developer is discharged from the developer drain hole according to the first embodiment of the present invention.
Figure 9:
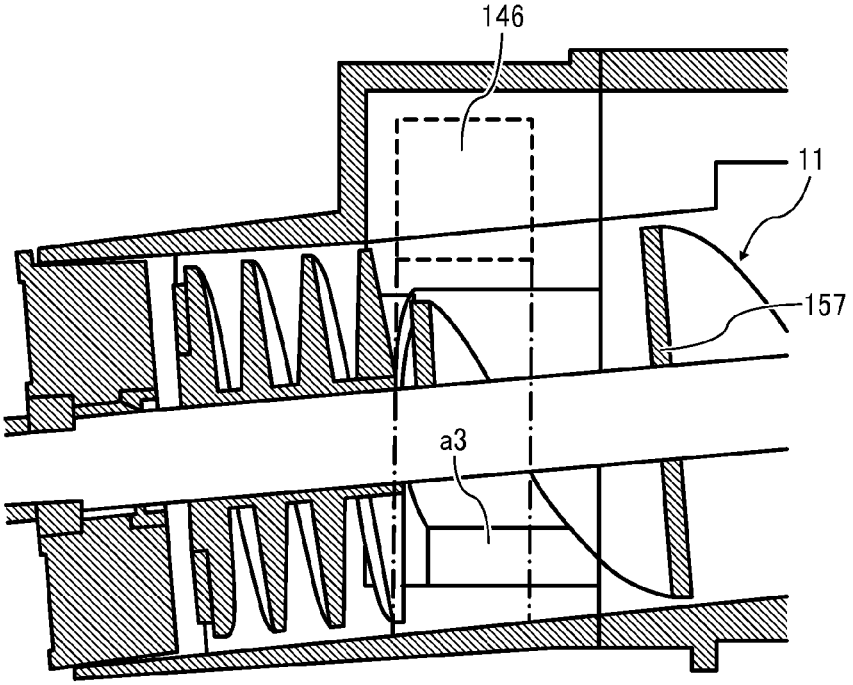
FIG. 9 is a cross-sectional view illustrating the developing unit of the developing unit when pushing out force of the developer collection screw applied to the developer toward the developer stiffing screw therefrom grows while a maximum amount of the developer is discharged from the developer drain hole, which is taken in a direction parallel to a rotary shaft of the developer stirring screw, according to the first embodiment of the present invention.

By contrast, when the paddle 156 of the developer collection screw 6 generates the maximum push out force directed toward the developer stiffing screw 11 as shown in FIG. 8 and it is viewed from the side wall having the developer drain hole 146 toward the developer collection screw 6, the developer stirring screw 11 may be positioned to minimize the region a3 of the lower side spiral blade 157 of the developer stirring screw 11 located below the rotary shaft thereof to hide the developer collection screw 6 as shown in FIG. 9. In such a situation, the spiral blade 157 of the developer stiffing screw 11 extremely accept the lateral developer flow coming from the developer collection screw 6 to the developer stiffing screw 11. Because of this, as shown in FIG. 8, the developer flow jumping up from below the developer stiffing screw 11 along the wall of the developer stirring conveyance channel 10 extremely becomes intensive. That is, the developer is conditioned to be extremely readily discharged from the developer drain hole 146.

Further, when a positional relation between the paddle 156 provided in the developer transfer section of the developer collection screw 6 and the spiral blade 157 of the developer stiffing screw 11 changes as both of these developer collection and stirring screws 6 and 11 rotate, the below described phenomenon occurs. That is, as both of these developer collection and stiffing screws 6 and 11 rotate, the developer flow jumping up from below the developer stiffing screw 11 along the wall of the developer stirring conveyance channel 10 pulsates and thereby becoming unstable. Because of this, although an amount of developer stored in the developing unit 4 is not increased up to a prescribed level that necessitates discharging thereof, the developer is forcibly discharged from the developer drain hole 146.

In addition, this phenomenon is noticeably occurs when the developing unit 4 stores a proper amount of developer or less. Because of this, since some developer stored in the developing unit 4 is discharged from the developer drain hole 146 although the amount of developer less than the proper level is stored in the developing unit 4, the amount of developer increasingly decreases below a required level, and accordingly supply of developer to the photoconductive body 1 likely becomes unstable. When supply of developer to the photoconductive body 1 becomes unstable, an abnormal image such as a drop out, etc., occurs as a result.

In this respect, according to this embodiment of the present invention, revolutions per unit of time (e.g., rpm (revolutions per minute)) of each of the developer collection screw 6 (i.e., a first developer conveyor) and the developer stirring screw 11 (i.e., a second developer conveyor) are equalized with each other while synchronizing respective rotational phases of the developer collection screw 6 and the developer stirring screw 11 with each other. In other words, the positional relation between the paddle 156 disposed in the developer collection screw 6 in the first developer transfer section 2*b* of the developing unit 4 and the spiral blade 157 of the developer stiffing screw 11 is controlled to be unchanged even as these developer collection and stiffing screws 6 and 11 rotate. With this, the above-described pulsation of the developer flow that jumps up from below the developer stirring screw 11 along the wall of the developer stirring conveyance channel 10 can be suppressed while stabilizing the above-described developer flow.

Hence, the developer stored in the developing unit 4 is inhibited from exiting from the developer drain hole 146 when the developing unit 4 stores an amount of developer less than the proper level. That is, an unique developing unit 4 capable of inhibiting developer from exiting from a developer drain hole 146 as long as the total amount of developer stored in the developing unit 4 does not need discharging of the developer can be provided.

In this respect, as shown in FIG. 6, the rotational phases of the developer collection screw 6 and the developer stirring screw 11 are fixed and fixed and synchronized with each other to locate the spiral blade 157 of the developer stiffing screw 11 at a position as shown in FIG. 7 when the paddle 156 provided in a first developer transfer section 2*b* of the developer collection screw 6 comes to a vertically downward position. Specifically, the rotational phase of the developer stirring screw 11 is fixed and synchronized to locate the spiral blade 157 thereof at a prescribed angular position at which the developer flow jumping up from below the developer stirring screw 11 along the wall of the developer stirring conveyance channel 10 is extremely weakened when the paddle 156 of the developer collection screw 6 generates the maximum push out force directed toward the developer stiffing screw 11. Hence, since respective rotational phases of the developer collection screw 6 and the developer stiffing screw 11 are fixed and synchronized with each other in this way, movement of the developer existing near the developer drain hole 146 can be more stabilized.

Accordingly, the developer stored in the developing unit 4 is more effectively inhibited from exiting from the developer drain hole 146 as long as the developing unit 4 stores an amount of developer less than the proper level. That is, a developing unit 4 capable of inhibiting developer from exiting from a developer drain hole 146 can be provided as long as the total amount of developer stored in the developing unit 4 does not need discharging of the developer. In addition, a copier 500 with the above-described developing unit 4 can more effectively reduce occurrence of an abnormal image, such as drop out, etc., generally caused when an amount of developer stored in the developing unit 4 falls below the required level and accordingly developer supply to the photoconductive body 1 becomes unstable.

Figure 10:
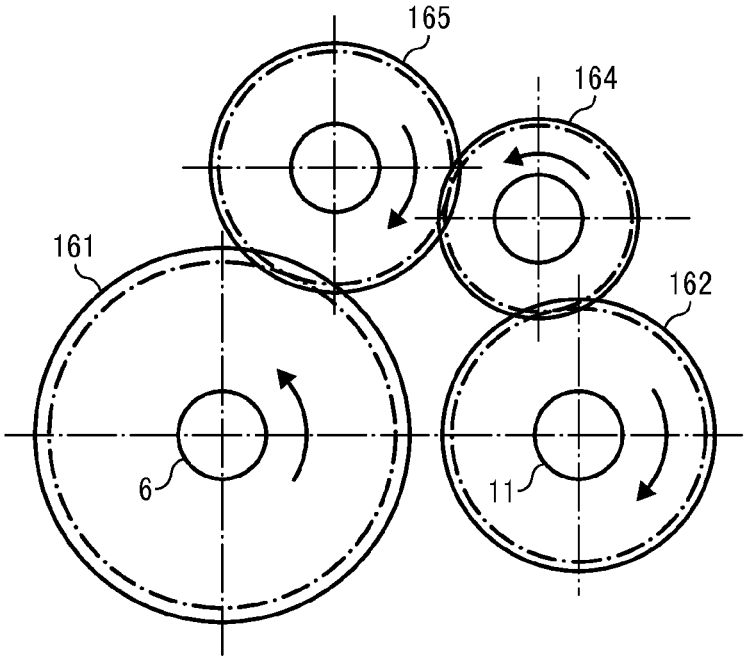
FIG. 10 is a diagram illustrating a first exemplary drive coupling system of coupling the developer collection screw with the developer stirring screw via a pair of gears according to the first embodiment of the present invention.

However, when the rotational phases of the developer collection screw 6 and the developer stiffing screw 11 are fixed and synchronized with each other as in the developing unit 4 of this embodiment by using a pair of conventional multiple driving gears which always directly engage with each other via the same teeth of those to drive the respective screws, the respective driving gears cause eccentric wear while likely increasing own vibration during rotation of those. In this respective, according to this embodiment of the present invention, as shown in FIG. 10, a synchronizing idler gear train composed of two synchronizing idler gears 164 and 165 are provided in the developing unit 4 between the collection driving gear 161 of the developer collection screw 6 and the stirring drive gear 162 of the developer stiffing screw 11, so that meshing phases of the respective driving gears can shift as they rotate. Since a configuration capable of shifting the meshing phases of the respective driving gears as they rotate is employed, eccentric wear and increasing in vibration, which are caused when the collection driving gear 161 of the developer collection screw 6 and the stirring drive gear 162 of the developer stiffing screw 11 directly engages with each other via the same teeth of those and rotate, can be prevented. Specifically, since the meshing phases of the driving gears of these screws can be shifted while synchronizing the rotational phases of the developer collection screw 6 and the developer stirring screw 11 with each other, the eccentric wear and the increasing in vibration, which are caused when the collection driving gear 161 of the developer collection screw 6 and the stirring drive gear 162 of the developer stiffing screw 11 directly engages with each other via the same teeth of those and are rotated, can be prevented.

Otherwise, the eccentric wear and accordingly the increasing in vibration, each of which is caused when the collection driving gear 161 of the developer collection screw 6 and the stirring drive gear 162 of the developer stiffing screw 11 directly engage with each other to rotate via the same teeth, can be also prevented by employing the below described system while synchronizing the rotational phases of the developer collection screw 6 and the developer stiffing screw 11 with each other.

Figure 11:
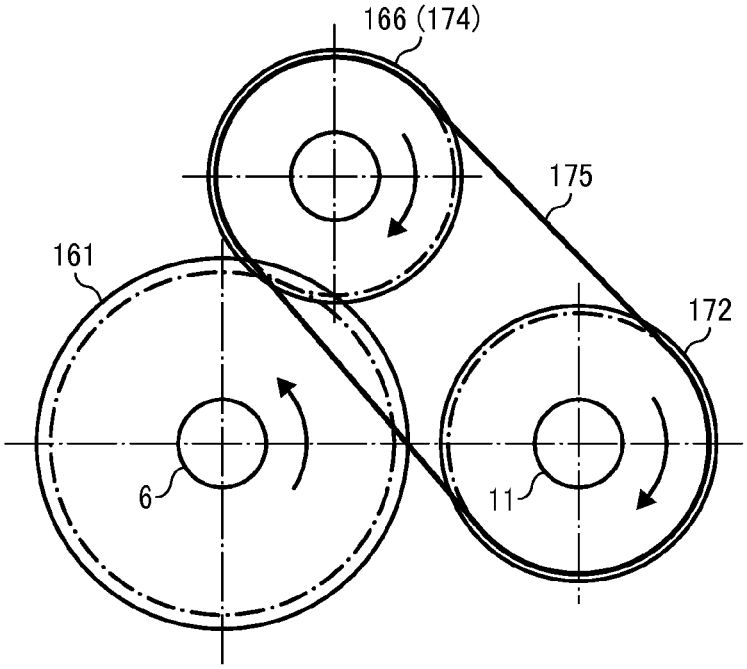
FIG. 11 is a diagram illustrating a second exemplary drive coupling system of coupling the developer collection screw with the developer stirring screw via a timing belt according to the first embodiment of the present invention.

Specifically, driving force is transferred between the developer collection screw 6 and the developer stirring screw 11 by using a timing belt 175 as shown in FIG. 11. That is, the other system again includes the collection driving gear 161 that drives and rotates the developer collection screw 6, a stiffing drive pulley 172 that drives and rotates the developer stirring screw 11, and a pulley 174 provided coaxial with a fourth synchronizing idler gear 166 that engages with the collection driving gear 161. With the above-described configuration, the timing belt 175 is tensioned between the pulley 174 and the stiffing drive pulley 172 to convey driving force therebetween.

With the above-described configuration, the similar advantage as obtained by the above-described system using the synchronizing gear train composed of two first and second synchronizing idler gears 164 and 165 as shown in FIG. 10 can be obtained here again. Further, since the drive force is transmitted via the timing belt 175, vibration caused due to meshing of the multiple gears can be more effectively reduced when compared with the driving transmission executed by using the synchronizing idler gear train composed of two synchronizing idler gears 164 and 165. In addition, since the number of gear engaging sections can be reduced, vibration caused due to the meshing of the gears can be more effectively reduced.

Here to fore, the system including the paddle 156 attached to the developer collection screw 6, which frequently prominently causes the above-described phenomenon in that the developer is unnecessary discharged from the developer drain hole 146 even though the total amount of developer stored in the developing unit does not increase up to a prescribed level that needs the above-described developer discharging, is described. However, the present invention is not limited to such a system, and can be applied to another configuration in that the paddle 156 is not attached to the developer collection screw 6. For example, rotational phases of the respective screws are fixed and synchronized with each other to enable the spiral blade 157 of the developer stirring screw 11 to extremely interfere with the developer flow directed toward the developer drain hole 146 when the paddle of the developer collection screw 6 disposed in the first developer transfer section 2*b* of the developer collection screw 6 generates the maximum lateral push out force. With the system configured in this way, as similar to the configuration in which the paddle 156 is disposed in the first developer transfer section 2*b* of the developer collection screw 6, the developer stored in the developing unit 4 is inhibited from exiting from the developer drain hole 146 when the developing unit 4 stores an amount of developer less than the proper level. Accordingly, an unique developing unit 4 capable of inhibiting the developer from exiting from the developer drain hole 146 as long as the total amount of developer stored in the developing unit 4 does not increase up to a prescribed level necessitating discharging thereof, can be provided.

Further, a process cartridge 18 at least including a photoconductive body 1 and the above-described developing unit 4 can obtain the similar advantage as obtained by the above-described developing unit 4 as well. In addition, a copier 500 at least including either the above-described developing unit 4 or the process cartridge 18 having the above-described developing unit 4 can obtain the similar advantage as obtained by either the above-described developing unit 4 or the process cartridge 18 having the above-described developing unit 4 as well. Further, occurrence of an abnormal image, such as drop out, etc., which is caused when an amount of developer stored in the developing unit 4 falls below the required level, and accordingly developer supply to the photoconductive body 1 becomes unstable, can be more effectively reduced.

Now, a second embodiment of the present invention is described with reference to applicable drawings. Here, the developing unit 4 of this embodiment is only different from the developing unit 4 of the above-described first embodiment in that a rotational phase of the developer supply screw 8 is also fixed and synchronized with the rotational phases of the developer collection screw 6 and the developer stirring screw 11. Hence, unless it is necessary to distinguish in the below described developing unit 4 of the second embodiment, the same numbers or codes are herein below assigned to identical or functionally similar structural elements to those assigned thereto in the first embodiment of the present invention. Redundant description of function and advantage is omitted from time to time as well.

Figure 12:
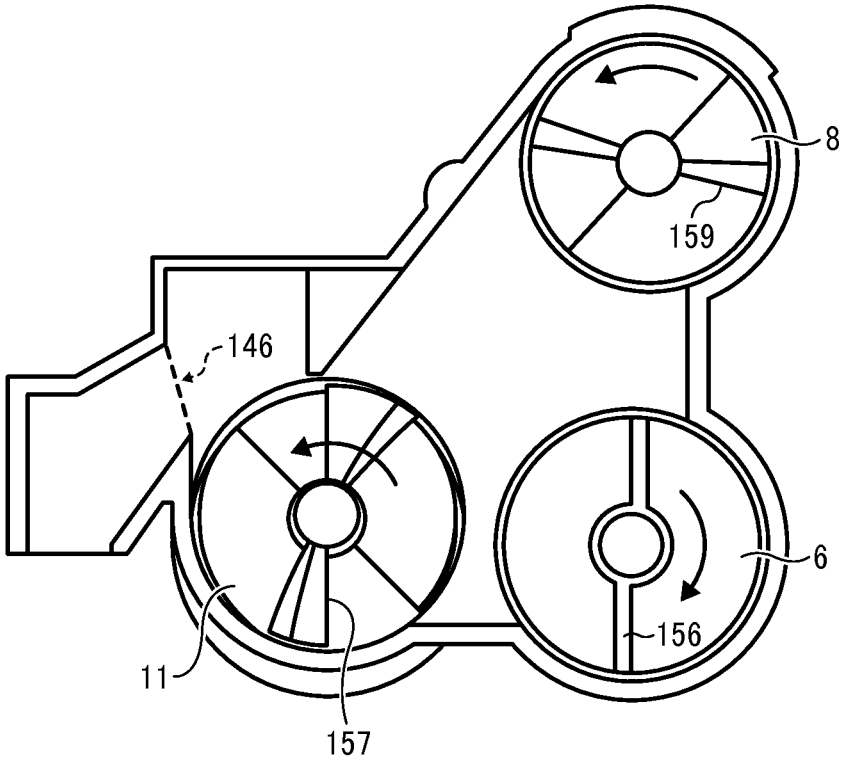
FIG. 12 is a cross-sectional view illustrating a developing unit in a developing unit attached to each of multiple process cartridges employed in the copier of FIG. 1, in which developer is delivered from a developer collection screw to a developer stirring screw, which is taken from a front side in FIG. 2, according to a second embodiment of the present invention.

In the above-described developing unit 4 of the first embodiment of the present invention, the flow of developer in the first developer transfer section 2*b* of the developing unit 4, in which developer is laterally transferred (or delivered) from the developer collection screw 6 (i.e., the first developer conveyor) to the developer stirring screw 11 (i.e., the second developer conveyor), is focused while constituting the developing unit 4 to weaken momentum of the developer flow directed toward the developer drain hole 146. In this embodiment, however, it is focused on coarseness and fineness occurring in the excessive developer that falls down to the developer collection screw 6 provided in the first developer transfer section 2*b* at the bottom of the developing unit 4 from the developer supply screw 8 (i.e., a third developer conveyor) having a spiral blade 159 as shown in FIG. 12.

Figure 13:
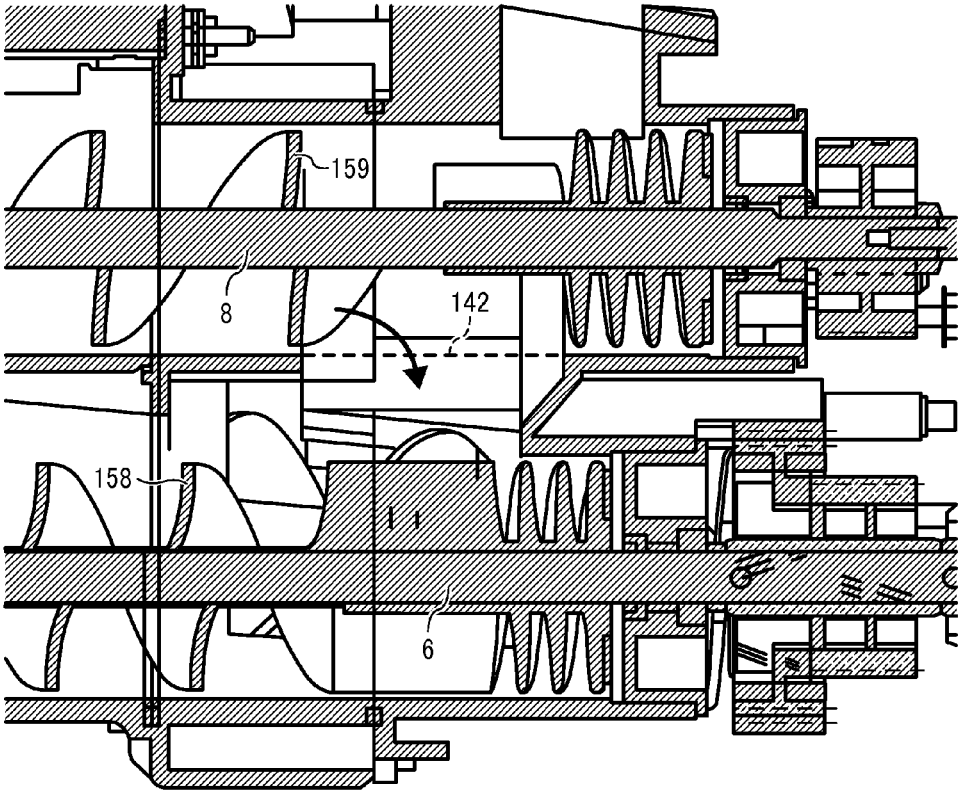
FIG. 13 is a cross-sectional view illustrating an aspect of the developing unit when a maximum amount of developer falls from a developer drop hole provided in a developer supply conveyance channel onto a developer collection screw, which is taken in a direction parallel to respective rotary shafts of the supply screw and the developer collection screw, according to a second embodiment of the present invention.
Figure 14:
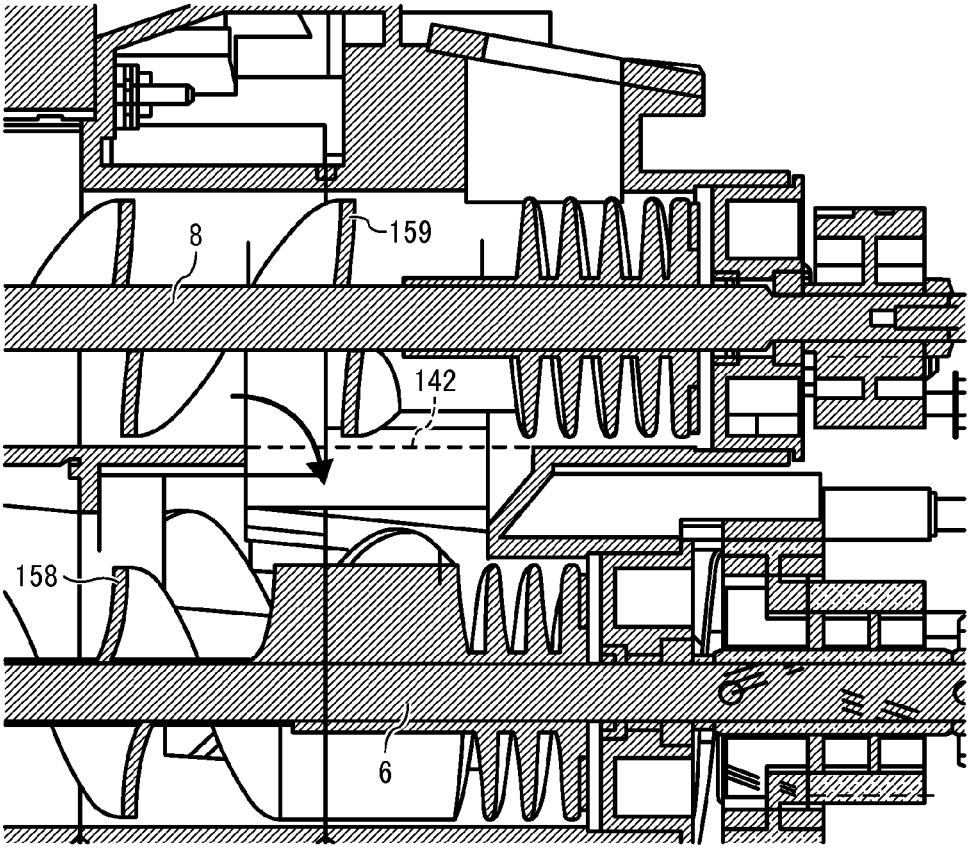
FIG. 14 is a cross-sectional view also illustrating an aspect of the developing unit when a minimum amount of developer falls from a developer drop hole provided in a developer supply conveyance channel onto a developer collection screw, which is taken in a direction parallel to respective rotary shafts of the supply screw and the developer collection screw, according to a second embodiment of the present invention.

Specifically, depending on a position of a bottom end of an outer circumference of the spiral blade 159 of the developer supply screw 8 in an axial direction thereof on a vertical imaginary plane that passes through an axis of a rotary shaft of the developer supply screw 8, coarseness and fineness of the developer occurs when it is transferred under the below described condition. That is, as shown in FIG. 13, when a position of a bottom of the outer circumference of the spiral blade 159 of the developer supply screw 8, which is disposed immediately upstream of the developer drop hole 142 in a direction of a rotational axis thereof (hereafter simply referred to as an axial direction), is equivalent to an upstream end of the developer drop hole 142 in a developer flowing direction, the greatest amount of developer falls therefrom. By contrast, as shown in FIG. 14, when the position of a bottom of the outer circumference of the spiral blade 159 of the developer supply screw 8, which is disposed immediately upstream of the developer drop hole 142 in a direction of a rotational axis thereof, is separated far from the upstream end of the developer drop hole 142 in the developer flowing direction, an amount of falling developer decreases. Because of this, coarseness and fineness occurs in the developer (i.e., the excessive developer) transferred from the developer supply screw 8 (i.e., the developer supply conveyance channel 9) to the developer collection screw 6 (i.e., the collected developer conveyance channel 7) disposed in the first developer transfer section 2*b* of the developing unit 4 via the developer drop hole 142 in accordance with a status of the developer supply screw 8 (i.e., a rotational phase thereof).

Due the developer coarseness and fineness, an amount of developer transferred from the developer collection screw 6 (i.e., the collected developer conveyance channel 7) to the developer stiffing screw 11 (i.e., the developer stirring conveyance channel 10) in the first developer transfer section 2*b* of the developing unit 4 accordingly changes as well. Because of this, intensity of the developer flow in a lateral direction from the developer collection screw 6 to the developer stiffing screw 11 caused by rotation of the developer collection screw 6 also changes depending on a change in amount of the excessive developer generated in the supply conveyance channel 9. Accordingly, intensity of the developer flow jumping up from below the developer stiffing screw 11 along the wall of the developer stirring conveyance channel 10 changes accordingly as described below in greater detail.

Figure 15:
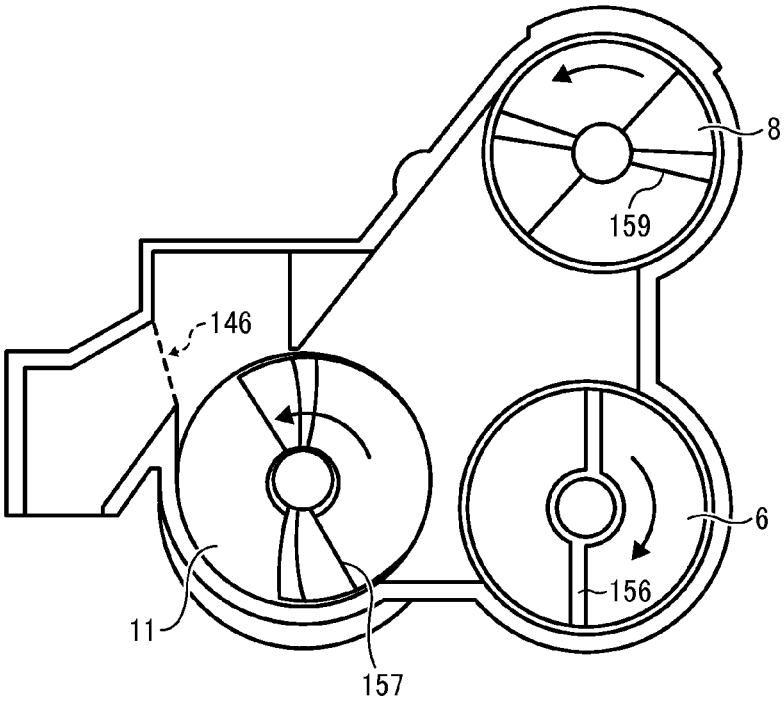
FIG. 15 is a vertical cross-sectional view illustrating an aspect of the developing unit when pushing out force of the developer collection screw applied to the developer toward the developer stiffing screw therefrom grows while a minimum amount of the developer is discharged from the developer drain hole according to the second embodiment of the present invention.

That is, when the paddle 156 provided in the first developer transfer section 2*b* of the developer collection screw 6 comes to a vertically downward position as shown in FIG. 15, the paddle 156 of the developer collection screw 6 generates a maximum push out force directed toward the developer stiffing screw 11. At this moment, when the bottom of the outer circumference of the spiral blade 159 of the developer supply screw 8 located immediately upstream of the developer drop hole 142 in the developer flow is laterally distanced from the developer drop hole 142 as shown in FIG. 14, an amount of developer falling from the developer drop hole 142 (i.e., the excessive developer) decreases.

When the developer collection screw 6 and the developer supply screw 8 are positioned as described above, the spiral blade 157 below the rotary shaft of the developer stiffing screw 11 may be positioned to extremely hide the region a3 of the developer collection screw 6 when it is viewed from the side wall having the developer drain hole 146 to the developer collection screw 6 at a position of the developer stirring screw 11 opposed to the developer drain hole 146 in the first developer transfer section 2*b* as shown in FIG. 7. In such a situation, the spiral blade 157 of the developer stirring screw 11 extremely impedes the lateral developer flow generated from the developer collection screw 6 to the developer stiffing screw 11. In addition, even though the paddle 156 of the developer collection screw 6 generates the maximum pushing force to push the developer, since an amount of developer pushed out in this way is decreased while interfering with the developer flow, the developer flow jumping up from below the developer stirring screw 11 along the wall of the developer stiffing conveyance channel 10 as shown in FIG. 15 becomes extremely weak. Since the developer flow jumping up from below the developer stiffing screw 11 is weakened, the developer becomes extremely hardly discharged from the developer drain hole 146.

Figure 16:
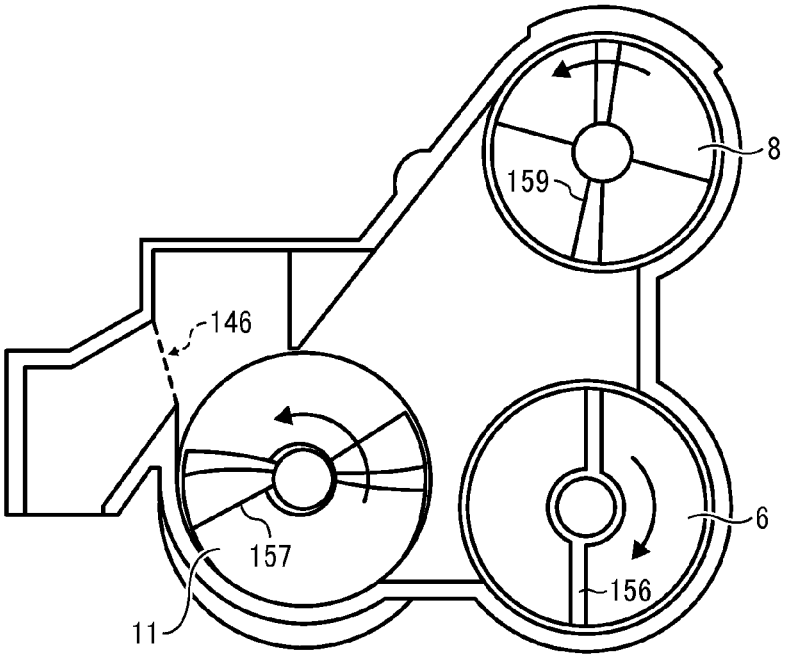
FIG. 16 is a cross-sectional view illustrating an aspect of a developing unit when pushing out force of the developer collection screw applied to the developer toward the developer stiffing screw therefrom grows while a maximum amount of the developer is discharged from the developer drain hole according to the second embodiment of the present invention.

By contrast, as shown in FIG. 16, when the paddle 156 comes to generate a maximum pushing force to push the developer toward the developer stiffing screw 11, and, as shown in FIG. 13, the bottom of the outer circumference of the spiral blade 159 of the developer supply screw 8 located immediately upstream of the developer drop hole 142 is laterally closest to the developer drop hole 142 in its axial direction, a maximum amount of developer falls from the developer drop hole 142 (i.e., the excessive developer). Further, as shown in FIG. 9, when the spiral blade 157 of the developer stirring screw 11 located below the rotary shaft thereof is positioned to hide a minimize region a3 of the developer collection screw 6 (i.e., disappear) when it is viewed from the side wall having the developer drain hole 146 toward the developer collection screw 6, the spiral blade 157 of the developer stirring screw 11 extremely allows horizontal developer flow from the developer collection screw 6 to the developer stirring screw 11.

Accordingly, since pushing force of the paddle 156 to push the developer becomes maximum, an amount of developer to be pushed out accordingly increases, and developer flow is readily accepted, the developer flow jumping up from below the developer stiffing screw 11 along the wall of the developer stirring conveyance channel 10 becomes extremely intensive as shown in FIG. 16. Due to the intensive developer flow jumping up from below the developer stirring screw 11, the developer is extremely readily discharged from the developer drain hole 146.

Hence, when a positional relation between the paddle 156 disposed in the first developer transfer section 2*b* of the developer collection screw 6 and the respective spiral blades 157 and 159 of the developer stiffing screw 11 and the developer supply screw 8 varies as each of these screws rotates, pulsation of jumping up of the developer from below the developer stiffing screw 11 along the wall of the developer stirring conveyance channel 10 highly likely grows when it is transferred from the developer collection screw 6 to the developer stiffing screw 11 though the first developer transfer section 2*b* depending on a variation amount of excessive developer stored in the developer supply conveyance channel 9. That is, the developer exits from the developer drain hole 146 even though the amount of developer stored in the developing unit 4 does not increased up to a prescribed level that necessitates discharging of the developer therefrom.

Again, such a phenomenon prominently occurs when a proper amount or less than that of developer is stored in the developing unit 4 as described in the first embodiment of the present invention. Because of this, since some developer stored in the developing unit 4 is discharged from the developer drain hole 146 although the amount of developer stored in the developing unit 4 is less than the proper level, the amount of developer likely becomes less than a required level, and accordingly supply of developer to a photoconductive body becomes unstable. When supply of developer to the photoconductive body 1 becomes unstable, an abnormal image such as drop out, etc., occurs as a result.

In this regard, in this embodiment, the number of revolutions per unit of time (e.g., rpm) of each of the developer collection screw 6 of the first developer conveyor, the developer stiffing screw 11 of the second developer conveyor, and the developer supply screw 8 of the third developer conveyor is equalized to each other while synchronizing these rotational phases of respective screws 6, 11, and 8 with each other. In other words, these rotational phases of respective screws are fixed and synchronized with each other so that a positional relation between the paddle 156 attached to the developer collection screw 6 in the first developer transfer section 2*b* and the spiral blade 157 of the developer stirring screw 11, and another positional relation between the spiral blade 159 of the developer supply screw 8 and the developer drop hole 142 do not change even when each of the screws rotates. Hence, even if the amount of excessive developer falling from the developer drop hole 142 varies, the above-described pulsation of the developer flow that jumps up from below the developer stiffing screw 11 along the wall of the developer stirring conveyance channel 10 can be suppressed while stabilizing the above-described developer flow.

Accordingly, even when the amount of excessive developer falling from the developer drop hole 142 varies, discharge of the developer from the developer drain hole 146 can be more effectively suppressed than in the first embodiment as long as the amount of developer stored in the developing unit 4 is the proper level or less. That is, an unique developing unit 4, which is capable of inhibiting developer from exiting from the developer drain hole 146 as long as the total amount of developer stored in the developing unit 4 is not increased up to a prescribed level that necessitates discharging thereof even when the amount of excessive developer falling from the developer drop hole 142 varies.

Further, when the positional relation between the respective spiral blades 157 and 159 of the developer stirring screw 11 and the developer supply screw 8 are fixed and synchronized with each other by a below described method when the paddle 156 of the developer collection screw 6 disposed in the first developer transfer section 2*b* comes to a vertically downward position, the developer flow can be more effectively stabilized. For example, a rotational phase of the developer stirring screw 11 is fixed and synchronized so that the spiral blade 157 of the developer stiffing screw 11 enters a state as shown in FIG. 7 when the paddle 156 of the developer collection screw 6 disposed in the first developer transfer section 2*b* of the developer collection screw 6 comes to a vertically downward position. That is, the rotational phase of the developer stirring screw 11 is fixed and synchronized to locate the spiral blade 157 thereof at a prescribed angular position at which the developer flow jumping up from below the developer stiffing screw 11 along the wall of the developer stirring conveyance channel 10 is extremely weakened when the paddle 156 of the developer collection screw 6 generates the maximum push out force directed toward the developer stiffing screw 11.

In addition, the rotational phase of the developer supply screw 8 is also fixed and synchronized so that the spiral blade 159 of the developer supply screw 8 enters a state as shown in FIG. 14 when the paddle 156 of the developer collection screw 6 disposed in the first developer transfer section 2*b* of the developer collection screw 6 comes to the vertically downward position as shown in FIG. 15. That is, as described earlier, the state shown in FIG. 14 represents that a bottom of an outer circumference of the spiral blade 159 of the developer supply screw 8, which is disposed immediately upstream of the developer drop hole 142, is distanced from the upstream end of the developer drop hole 142 in a direction of a rotational axis thereof. Specifically, the rotational phase of the developer supply screw 8 is fixed and synchronized at the prescribed level capable of decreasing an amount of excessive developer falling from the developer drop hole 142 provided above the first developer transfer section 2*b* when the paddle 156 of the developer collection screw 6 generates the maximum push out force directed toward the developer stirring screw 11.

Hence, by synchronizing the rotational phases of the developer collection screw 6, the developer stirring screw 11, and the developer supply screw 8 with each other, the below described advantages may be obtained. That is, by decreasing the amount of excessive developer falling from the developer drop hole 142 when the paddle 156 of the developer collection screw 6 generates the maximum push out force, a pushed out amount of developer can be reduced. By reducing the amount of excessive developer in this way, lateral developer flow from the developer collection screw 6 can be more effectively weakened by the spiral blade 157 of the developer stirring screw 11 when compared with a system, in which the amount of excessive developer falling from the developer drop hole 142 is not decreased when the paddle 156 of the developer collection screw 6 generates the maximum push out force. With this, even if the amount of excessive developer falling from the developer drop hole 142 varies, occurrence of pulsation of the developer flow that jumps up from below the developer stirring screw 11 along the wall of the developer stirring conveyance channel 10 can be more desirably suppressed than the first embodiment of the present invention. In addition, movement of developer in the vicinity of the developer drain hole 146 can be more effectively stabilized than the first embodiment of the present invention.

Further, the rotational phases of the developer collection screw 6, the developer stirring screw 11, and the developer supply screw 8 can be differently fixed and synchronized with each other in a below described method. That is, the rotational phase of the developer stiffing screw 11 is fixed and synchronized so that the spiral blade 157 of the developer stiffing screw 11 enters a state as shown in FIG. 7 when the paddle 156 of the developer collection screw 6 disposed in the first developer transfer section 2*b* of the developer collection screw 6 comes to a vertically downward position. Specifically, the rotational phase of the developer stirring screw 11 is fixed and synchronized to locate the spiral blade 157 thereof at a prescribed angular position at which the developer flow jumping up from below the developer stirring screw 11 along the wall of the developer stirring conveyance channel 10 is extremely weakened when the paddle 156 of the developer collection screw 6 generates the maximum push out force directed toward the developer stiffing screw 11.

In addition, the rotational phase of the developer supply screw 8 is also fixed and synchronized so that the spiral blade 159 of the developer supply screw 8 enters a state as shown in FIG. 13 when the paddle 156 of the developer collection screw 6 disposed in the first developer transfer section 2*b* of the developer collection screw 6 comes to a vertically downward position. That is, as described earlier, the state as shown in FIG. 13 represents that the bottom of the outer circumference of the spiral blade 159 of the developer supply screw 8 located immediately upstream of the developer drop hole 142 is positioned laterally closest to the developer drop hole 142 in its rotary axis direction. Accordingly, when the paddle 156 of the developer collection screw 6 generates the maximum push out force directed toward the developer stiffing screw 11, the rotational phase of the developer supply screw 8 is fixed and synchronized to maximize the amount of excessive developer falling down from the developer drop hole 142 provided above the first developer transfer section 2*b*.

Further, by synchronizing the rotational phases of the developer collection screw 6, the developer stirring screw 11, and the developer supply screw 8 with each other, the below described advantages can be also expected. That is, when the paddle 156 of the developer collection screw 6 and the spiral blade 159 of the developer supply screw 8 are located at positions, at each of which the developer is extremely easily discharged from the developer drain hole 146, the spiral blade 157 of the developer stirring screw 11 can be located at a position to extremely interfere with the developer flow. Accordingly, maximum intensity of the developer flow that tends to jump up toward the developer drain hole 146 can be precisely reduced. With this, even if the amount of excessive developer falling from the developer drop hole 142 varies, occurrence of pulsation of the developer flow that jumps up from below the developer stirring screw 11 along the wall of the developer stiffing conveyance channel 10 can be more desirably suppressed than the first embodiment of the present invention. In addition, movement of developer in the vicinity of the developer drain hole 146 can be more effectively stabilized than the first embodiment of the present invention as well.

With this, even if the amount of excessive developer falling from the developer drop hole 142 varies, the developer stored in the developing unit 4 is more effectively inhibited from exiting from the developer drain hole 146 than the first embodiment of the present invention as long as the developing unit 4 stores an amount of developer less than the proper level. Hence, the developer is more effectively inhibited from exiting from the developer drain hole 146 when the total amount of developer stored in the developing unit 4 is not increased up to a prescribed level that necessitates discharging thereof than the first embodiment of the present invention even if the amount of excessive developer falling from the developer drop hole 142 varies. Further, in a copier 500 with the above-described developing unit 4, occurrence of an abnormal image, such as drop out, etc., which is caused when an amount of developer stored in the developing unit 4 falls below the required level, and accordingly developer supply to the photoconductive body 1 becomes unstable, can be more effectively reduced.

Further, in this embodiment of the present invention, when the rotational phases of the developer collection screw 6, the developer stiffing screw 11, and the developer supply screw 8 are fixed and synchronized with each other as well, the above-described eccentric wear and accordingly increasing in vibration of the driving gears, which are likely caused when the multiple driving gears of the screws engage with each other to rotate via the same teeth thereof, can be also prevented by using the below described system.

Figure 17:
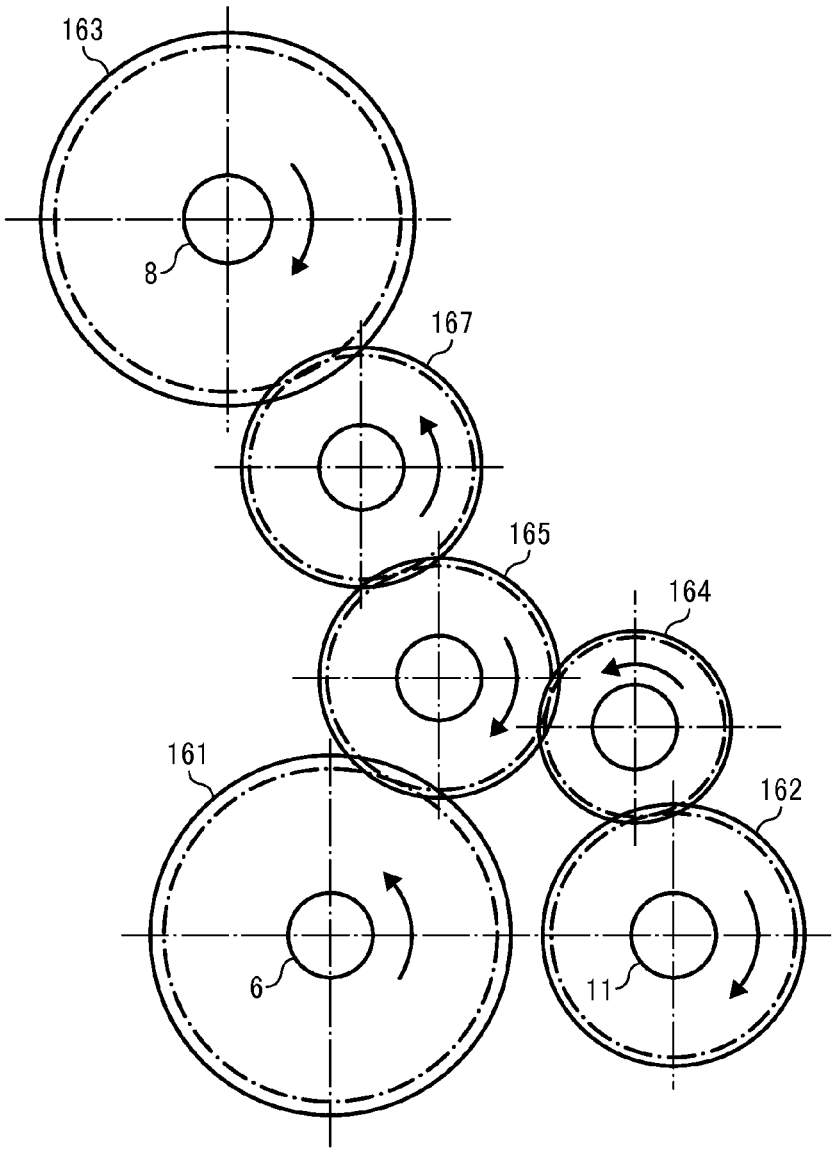
FIG. 17 is a diagram illustrating a third exemplary drive coupling system of coupling the developer collection screw, the developer stiffing screw, and the supply screw with each other via multiple gears according to the second embodiment of the present invention.

For example, another transmission system as shown in FIG. 17 may be employed when multiple synchronizing idler gears are used to transfer driving force between the respective driving gears of the developer collection screw 6, the developer stirring screw 11, and the developer supply screw 8. That is, as shown there, in addition to the driving system of the synchronizing idler gear train as described in the first embodiment with reference to FIG. 10, a third synchronizing idler gear 167 is provided to mesh with a supply driving gear 163 that drives and rotates the developer supply screw 8. That is, while engaging with the supply driving gear 163, the third synchronizing idler gear 167 meshes with a second synchronizing idler gear 165 of the synchronizing idler gear train, which engages with the collection driving gear 161. That is, three synchronizing idler gears 164, 165, and 167 (i.e., two synchronizing idler gears 164 and 165 in the synchronizing idler gear train and one third synchronizing idler gear 167) are provided such that the second synchronizing idler gear 165 of the synchronizing idler gear train engages with both the first and third synchronizing idler gears 165 with each other while engaging with the developer collection driving gear 161.

It is to be noted that, as in the first embodiment of the present invention, this embodiment also includes a system, in which the paddle 156 is attached to the developer collection screw 6 as described heretofore. However, the present invention is not limited to such a system, and can be similarly applied to a different system, in which the paddle 156 is not attached to the developer collection screw 6 as in the first embodiment of the present invention.

Further, in this embodiment, the present invention is applied to the copier 500 employing four process cartridges 18Y, 18M, 18C, and 18K. However, the present invention is not limited to such a system as well. For example, the present invention can be applied to either an image forming apparatus only including a single process cartridge as well. Further, the present invention can be also applied to an image forming apparatus, such as a printer, a facsimile machine, a multifunctional device, etc.

Hence, according to one aspect of the present invention, since rotational phases of the first and second transfer members are fixed and synchronized with each other, that is, a positional relation between respective spiral blades of first and second developer conveyors in the developer transfer section, in which developer is laterally transferred, does not change even when screws of the respective first and second developer conveyors rotate, pulsation of developer flow that jumps up from below the second developer conveyor along the wall of a second developer conveyance channel can be suppressed while stabilizing the above-described developer flow. Accordingly, the developer stored in the developing unit is effectively inhibited from exiting from a developer drain hole as long as a developing unit stores a proper amount of developer or less. Specifically, an unique developing unit, which is capable of inhibiting the developer from exiting from the developer drain hole when the total amount of developer stored in the developing unit is not increased up to a prescribed level that necessitates discharging thereof can be provided. That is, according to one aspect of the present invention, a developing unit includes a developer bearer to bear developer on a surface thereof, a first developer conveyor having a spiral blade mounted on a rotary shaft thereof parallel to a rotary axis of the developer bearer to convey developer in a first direction, and a second developer conveyor having a spiral blade mounted on a rotary shaft thereof parallel to the rotary axis of the developer bearer to convey developer in a second direction opposite the first direction. A first developer conveyance channel includes the first developer conveyor. A second developer conveyance channel includes the second developer conveyor. A partition wall is provided to separate the first developer conveyance channel the second developer conveyance channel from each other. A communication opening is formed in the partition wall to communicate the first developer conveyance channel with the second developer conveyance channel at a prescribed position near a downstream end of the first developer conveyance channel including the first developer conveyor and an upstream end of the second developer conveyance channel including the second developer conveyor. Each of the downstream end and the upstream end horizontally is aligned there with each other. A developer drain hole is provided to drain the developer from the developing unit. The developer drain hole is provided at a given height in a side wall of the second developer conveyance channel while facing the communication opening across the second developer conveyor. The first developer conveyor rotates in a prescribed direction with its spiral blade rising between the rotary shaft of the first developer conveyor and the communication opening. Rotational phases of the first developer conveyor and the second developer conveyor are fixed and synchronized with each other to weaken momentum of developer flow generated by the first developer conveyor toward the developer drain hole via the second developer conveyor.

According to another aspect of the present invention, since a positional relation between respective spiral blades of first and second developer conveyors in the developer transfer section, in which developer is laterally transferred, and that between a developer drop hole and a spiral blade of the third developer conveyor do not change, respectively, occurrence of pulsation of developer flow that jumps up from below the second conveyor along the wall of the second developer conveyance channel can be suppressed while stabilizing developer flow when these screws of first and second developer conveyors rotate even if an amount of excessive developer falling from a developer drop hole varies. That is, even if the amount of excessive developer falling from the developer drop hole varies, the developer stored in the developing unit is more effectively inhibited from exiting from the developer drain hole as long as the developing unit stores an amount of developer less than the proper level. That is, according to another aspect of the present invention, a third developer conveyance channel is additionally provided above the first developer conveyance channel and includes a developer drop hole at one end. A third developer conveyor is provided in the third developer conveyance channel and includes at least a spiral blade mounted on a rotary shaft thereof to convey the developer toward the developer drop hole formed in the third developer conveyance channel. The third developer conveyor drops and transfers the developer from the developer drop hole to the first developer conveyor. A rotational phase of the third developer conveyor is also fixed and synchronized with a rotational phase of each of the first developer conveyor and the second developer conveyor.

According to yet another aspect of the present invention, the rotational phase of the second developer conveyor can be fixed and synchronized to locate the spiral blade thereof at a prescribed angular position, at which the developer flow jumping up from below the second developer conveyor toward the developer drain hole is extremely weakened when the first developer conveyor generates the maximum push out force directed toward the second developer conveyor. In this way, since respective rotational phases of the first and second developer conveyors are fixed and synchronized with each other, movement of the developer existing near the developer drain hole can be more stabilized. Accordingly, the developer stored in the developing unit or the like is further effectively inhibited from exiting from the developer drain hole as long as the developing unit stores an amount of developer less than the proper level. That is, according to yet another aspect of the present invention, rotational phases of the first developer conveyor and the second developer conveyor are fixed and synchronized with each other to maximize a region of the first developer conveyor hidden by the spiral blade located below the rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole.

According to yet another aspect of the present invention, the spiral blade of the second developer conveyor can be located at a position to extremely interfere with developer flow when developer is extremely easily discharged from the developer drain hole due to rotational phases of the first and third developer conveyors. Hence, maximum intensity of the developer flow that tends to jump up toward the developer drain hole 146 can be precisely reduced. With this, occurrence of pulsation of developer flow that jumps up from below the second conveyor along the wall of the second developer conveyance channel can be more effectively suppressed while stabilizing developer flow even if an amount of excessive developer falling from a developer drop hole varies. In addition, movement of the developer existing near the developer drain hole can be more stabilized again. Accordingly, even if the amount of excessive developer falling from the developer drop hole varies, the developer stored in the developing unit 4 is more effectively inhibited from exiting from the developer drain hole as long as the developing unit stores an amount of developer less than the proper level.

That is, according to yet another aspect of the present invention, the rotational phases of the first developer conveyor, the second developer conveyor, and the third developer conveyor are fixed and synchronized with each other to maximize a region of the first developer conveyor hidden by the spiral blade of the second developer conveyor located below the rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole. The rotational phases of the first developer conveyor, the second developer conveyor, and the third developer conveyor are fixed and synchronized with each other so that an axial position of a bottom of an outer circumference of the spiral blade of the third developer conveyor disposed upstream in a developer conveying direction closest to the developer drop hole is aligned with a position of an upstream end of the developer drop hole in the developer conveying direction on an imaginary plane vertically extended including an axis of the rotary shaft of the third developer conveyor.

According to yet another aspect of the present invention, since the amount of excessive developer falling from the developer drop hole is decreased when the first developer conveyor generates the maximum push out force, a pushed out amount of developer can be reduced. By reducing the amount of excessive developer in this way, the lateral developer flow from the first developer conveyor can be more effectively weakened by the spiral blade of the second developer conveyor when compared with a system, in which the amount of excessive developer falling from the developer drop hole is not decreased when the first developer conveyor generates the maximum push out force. Hence, occurrence of pulsation of the developer flow that jumps up from below the second conveyor along the wall of the second developer conveyance channel can be further effectively suppressed even if the amount of excessive developer falling from the developer drop hole varies. In addition, movement of the developer existing near the developer drain hole can be further stabilized as well. Accordingly, even if the amount of excessive developer falling from the developer drop hole varies, the developer stored in the developing unit 4 is further effectively inhibited from exiting from the developer drain hole as long as the developing unit 4 stores an amount of developer less than the proper level. That is, according to yet another aspect of the present invention, the rotational phases of the first developer conveyor, the second developer conveyor, and the third developer conveyor are fixed and synchronized with each other to maximize a region of the first developer conveyor hidden by the spiral blade of the second developer conveyor located below the rotary shaft of the second developer conveyor when a maximum pushing force is applied by the first developer conveyor to the developer toward the second developer conveyor through the communication opening and the first developer conveyor is viewed from the side wall of the second developer conveyor having the developer drain hole. The rotational phases of the first developer conveyor, the second developer conveyor, and the third developer conveyor are fixed and synchronized with each other so that an axial position of a bottom of an outer circumference of the spiral blade of the third developer conveyor disposed upstream in a developer conveying direction closest to the developer drop hole in an axial direction thereof is separated from a position of an upstream end of the developer drop hole in a developer conveying direction on an imaginary plane vertically extended including an axis of a rotary shaft of the third developer conveyor.

According to yet another aspect of the present invention, similar advantage to that as described above can be also obtained by a system, in which a paddle is attached to the first developer conveyor that accordingly generates maximum intensity of pushing developer out toward the second developer conveyor, such as a developer stiffing screw, etc., through an opening formed in a third partition wall when the paddle comes to a vertically downward position, for example. That is, according to yet another aspect of the present invention, a paddle is attached to the first developer conveyor opposed to the communication opening to apply force to the developer in a rotational direction of the first developer conveyor.

According to yet another aspect of the present invention, since meshing phases of the respective driving gears of the screws can be shifted while synchronizing the rotational phases of first and second developer conveyors with each other, the eccentric wear and the increasing in vibration caused when these driving gears directly engage with each other to rotate via the same teeth of those can be prevented. That is, according to yet another aspect of the present invention, a first driving gear is attached to the first developer conveyor. A second driving gear is also attached to the second developer conveyor. At least one synchronizing idler gear is engaged with both the first driving gear and the second driving gear. Rotational driving force is transmitted from one of the first driving gear and the second driving gear to the other one of the first driving gear and the second driving gear, respectively, via the at least one synchronizing idler gear.

According to yet another aspect of the present invention, the similar advantage to that as described above can be obtained as well. In addition, since the drive force is transmitted via a timing belt 175, vibration caused by meshing of gears can be effectively reduced when compared with a drive transmission system employing the gears. That is, according to yet another aspect of the present invention, a timing belt is provided instead of the first and second gears to transmit rotational driving force transmitted to one of the first developer conveyor and the second developer conveyor to the other one of the first developer conveyor and the second developer conveyor.

According to yet another aspect of the present invention, an unique process cartridge including a developing unit can be provided while having the similar advantage as the above-described developing unit. That is, according to yet another aspect of the present invention, a process cartridge for an image forming apparatus includes a developing unit to develop a latent image formed on a latent image bearer. The developing unit includes a developer bearer to bear developer on a surface thereof, a first developer conveyor having a spiral blade mounted on a rotary shaft thereof parallel to a rotary axis of the developer bearer to convey developer in a first direction, and a second developer conveyor having a spiral blade mounted on a rotary shaft thereof parallel to the rotary axis of the developer bearer to convey developer in a second direction opposite the first direction. A first developer conveyance channel is provided while including the first developer conveyor. A second developer conveyance channel is provided while including the second developer conveyor. A partition wall is provided to separate the first conveyance channel and the second developer conveyance channel from each other. A communication opening is formed in the partition wall to communicate the first developer conveyance channel with the second developer conveyance channel at a prescribed position near a downstream end of the first developer conveyance channel including the first developer conveyor and an upstream end of the second developer conveyance channel including the second developer conveyor. Each of the downstream end and the upstream end is horizontally aligned there with each other. A developer drain hole is provided to drain the developer from the developing unit 4 to an outside thereof. The developer drain hole is provided at a given height in a side wall of the second developer conveyance channel while facing the communication opening across the second developer conveyor. The first developer conveyor rotates in a direction with its spiral blade rising between the rotary shaft of the first developer conveyor and the communication opening. Rotational phases of the first developer conveyor and the second developer conveyor are fixed and synchronized with each other to weaken momentum of developer flow generated by the first developer conveyor toward the developer drain hole via the second developer conveyor.

According to yet another aspect of the present invention, an unique image forming apparatus having either a process cartridge including a developing unit or a developing unit alone can be provided while having the similar advantage as the above-described process cartridge or the developing unit. That is, according to yet another aspect of the present invention, an image forming apparatus includes a latent image bearer to bear an electrostatic latent image on a surface thereof, an electrostatic latent image forming device to form the electrostatic latent image on the latent image bearer, and a developing unit to develop the electrostatic latent image formed on the latent image bearer. The developing unit includes a developer bearer to bear developer on a surface thereof, a first developer conveyor having a spiral blade mounted on a rotary shaft thereof parallel to a rotary axis of the developer bearer to convey developer in a first direction, and a second developer conveyor having a spiral blade mounted on a rotary shaft thereof parallel to the rotary axis of the developer bearer to convey developer in a second direction opposite the first direction. A first developer conveyance channel is provided while including the first developer conveyor. A second developer conveyance channel is provided while including the second developer conveyor. A partition wall is provided to separate the first conveyance channel and the second developer conveyance channel from each other. A communication opening is formed in the partition wall to communicate the first developer conveyance channel with the second developer conveyance channel at a prescribed position near a downstream end of the first developer conveyance channel including the first developer conveyor and an upstream end of the second developer conveyance channel including the second developer conveyor. Each of the downstream end and the upstream end is horizontally aligned there with each other. A developer drain hole is provided to drain the developer from the developing unit 4. The developer drain hole is provided at a given height in a side wall of the second developer conveyance channel while facing the communication opening across the second developer conveyor. The first developer conveyor rotates in a direction with its spiral blade rising between the rotary shaft of the first developer conveyor and the communication opening. Rotational phases of the first developer conveyor and the second developer conveyor are fixed and synchronized with each other to weaken momentum of developer flow generated by the first developer conveyor toward the developer drain hole via the second developer conveyor.

Numerous additional modifications and variations of the present invention are possible in light of the above teachings. It is therefore to be understood that within the scope of the appended claims, the present invention may be executed otherwise than as specifically described herein. For example, the developing unit, the process cartridge, and the image forming apparatus are not limited to the above-described various embodiments and modifications and may be altered as appropriate.

What is claimed is:

1. A developing unit comprising:

a developer bearer configured to bear developer on a surface thereof;

a first developer conveyor having a spiral blade mounted on a rotary shaft thereof parallel to a rotary axis of the developer bearer to convey developer in a first direction;

a second developer conveyor having a spiral blade mounted on a rotary shaft thereof parallel to the rotary axis of the developer bearer to convey developer in a second direction opposite the first direction;

a first developer conveyance channel including the first developer conveyor;

a second developer conveyance channel including the second developer conveyor;

a partition wall to separate the first developer conveyance channel and the second developer conveyance channel from each other;

a communication opening formed in the partition wall to communicate the first developer conveyance channel with the second developer conveyance channel at a position near a downstream end of the first developer conveyance channel including the first developer conveyor and an upstream end of the second developer conveyance channel including the second developer conveyor, each of the downstream end and the upstream end horizontally aligned with each other; and a developer drain hole to drain the developer from the developing unit, the developer drain hole provided at a given height in a side wall of the second developer conveyance channel to face the communication opening across the second developer conveyor, wherein the first developer conveyor rotates in a direction with the spiral blade thereof rising between the rotary shaft of the first developer conveyor and the communication opening, wherein rotational phases of the first developer conveyor and the second developer conveyor are fixed and synchronized with each other to weaken momentum of developer flow generated by the first developer conveyor toward the developer drain hole via the second developer conveyor.

2. The developing unit as claimed in claim 1, further comprising:

a third developer conveyance channel provided above the first developer conveyance channel and having a developer drop hole at one end thereof; and a third developer conveyor included in the third developer conveyance channel and having at least a spiral blade mounted on a rotary shaft thereof to convey the developer toward the developer drop hole and drop the developer therefrom to transfer the developer from the developer drop hole to the first developer conveyor, wherein a rotational phase of the third developer conveyor is fixed and synchronized with a rotational phase of each of the first developer conveyor and the second developer conveyor.

3. The developing unit as claimed in claim 2, wherein the rotational phases of the first developer conveyor, the second developer conveyor, and the third developer conveyor are fixed and synchronized with each other to maximize a region of the first developer conveyor hidden by the spiral blade of the second developer conveyor located below the rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole, the rotational phases of the first developer conveyor, the second developer conveyor, and the third developer conveyor fixed and synchronized with each other so that an axial position of a bottom of an outer circumference of the spiral blade of the third developer conveyor disposed upstream in a developer conveying direction closest to the developer drop hole is aligned with a position of an upstream end of the developer drop hole in the developer conveying direction on an imaginary plane vertically extended including an axis of the rotary shaft of the third developer conveyor.

4. The developing unit as claimed in claim 2, wherein the rotational phases of the first developer conveyor, the second developer conveyor, and the third developer conveyor are fixed and synchronized with each other to maximize a region of the first developer conveyor hidden by the spiral blade of the second developer conveyor located below the rotary shaft of the second developer conveyor when a maximum pushing force is applied by the first developer conveyor to the developer toward the second developer conveyor through the communication opening and the first developer conveyor is viewed from the side wall of the second developer conveyor having the developer drain hole, the rotational phases of the first developer conveyor, the second developer conveyor, and the third developer conveyor fixed and synchronized with each other so that an axial position of a bottom of an outer circumference of the spiral blade of the third developer conveyor disposed upstream in a developer conveying direction closest to the developer drop hole in an axial direction thereof is separated from a position of an upstream end of the developer drop hole in a developer conveying direction on an imaginary plane vertically extended including an axis of a rotary shaft of the third developer conveyor.

5. The developing unit as claimed in claim 1, wherein rotational phases of the first developer conveyor and the second developer conveyor are fixed and synchronized with each other to maximize a region of the first developer conveyor hidden by the spiral blade of the second developer conveyor located below a rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole.

6. The developing unit as claimed in claim 1, further comprising a paddle attached to the first developer conveyor, the paddle opposed to the communication opening to apply force to the developer in a rotational direction of the first developer conveyor.

7. The developing unit as claimed in claim 1, further comprising:

a first driving gear attached to the first developer conveyor;

a second driving gear attached to the second developer conveyor; and at least one synchronizing idler gear engaged with both the first driving gear and the second driving gear, wherein rotational driving force is transmitted from one of the first driving gear and the second driving gear to the other one of the first driving gear and the second driving gear, respectively, via the at least one synchronizing idler gear.

8. The developing unit as claimed in claim 1, further comprising a timing belt to transmit rotational driving force transmitted to one of the first developer conveyor and the second developer conveyor to the other one of the first developer conveyor and the second developer conveyor.

9. A process cartridge for an image forming apparatus, the process cartridge comprising:

a latent image bearer to bear an electrostatic latent image on a surface thereof; and the developing unit of claim 1.

10. The process cartridge as claimed in claim 9, further comprising:

a third developer conveyance channel provided above the first developer conveyance channel and having a developer drop hole at one end thereof; and a third developer conveyor included in the third developer conveyance channel and having at least a spiral blade mounted on a rotary shaft thereof to convey the developer toward the developer drop hole and drop the developer therefrom to transfer the developer from the developer drop hole to the first developer conveyor, wherein a rotational phase of the third developer conveyor is fixed and synchronized with a rotational phase of each of the first developer conveyor and the second developer conveyor.

11. The process cartridge as claimed in claim 10, wherein the rotational phases of the first developer conveyor, the second developer conveyor, and the third developer conveyor are fixed and synchronized with each other to maximize a region of the first developer conveyor hidden by the spiral blade of the second developer conveyor located below the rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole, the rotational phases of the first developer conveyor, the second developer conveyor, and the third developer conveyor fixed and synchronized with each other so that an axial position of a bottom of an outer circumference of the spiral blade of the third developer conveyor disposed upstream in a developer conveying direction closest to the developer drop hole is aligned with a position of an upstream end of the developer drop hole in the developer conveying direction on an imaginary plane vertically extended including an axis of the rotary shaft of the third developer conveyor.

12. The process cartridge as claimed in claim 9, wherein rotational phases of the first developer conveyor and the second developer conveyor are fixed and synchronized with each other to maximize a region of the first developer conveyor hidden by the spiral blade of the second developer conveyor located below a rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole.

13. An image forming apparatus comprising:

a latent image bearer to bear an electrostatic latent image on a surface thereof;

an electrostatic latent image forming device to form the electrostatic latent image on the latent image bearer; and the developing unit of claim 1.

14. The image forming apparatus as claimed in claim 13, further comprising a process cartridge removably attached to the image forming apparatus, the process cartridge including the developing unit and the latent image bearer.

15. The image forming apparatus as claimed in claim 13, further comprising:

a third developer conveyance channel provided above the first developer conveyance channel and having a developer drop hole at one end thereof; and a third developer conveyor included in the third developer conveyance channel and having at least a spiral blade mounted on a rotary shaft thereof to convey the developer toward the developer drop hole and drop the developer therefrom to transfer the developer from the developer drop hole to the first developer conveyor, wherein a rotational phase of the third developer conveyor is fixed and synchronized with a rotational phase of each of the first developer conveyor and the second developer conveyor.

16. The image forming apparatus as claimed in claim 15, wherein the rotational phases of the first developer conveyor, the second developer conveyor, and the third developer conveyor are fixed and synchronized with each other to maximize a region of the first developer conveyor hidden by the spiral blade of the second developer conveyor located below the rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole, the rotational phases of the first developer conveyor, the second developer conveyor, and the third developer conveyor fixed and synchronized with each other so that an axial position of a bottom of an outer circumference of the spiral blade of the third developer conveyor disposed upstream in a developer conveying direction closest to the developer drop hole is aligned with a position of an upstream end of the developer drop hole in the developer conveying direction on an imaginary plane vertically extended including an axis of the rotary shaft of the third developer conveyor.

17. The image forming apparatus as claimed in claim 15, wherein the rotational phases of the first developer conveyor, the second developer conveyor, and the third developer conveyor are fixed and synchronized with each other to maximize a region of the first developer conveyor hidden by the spiral blade of the second developer conveyor located below the rotary shaft of the second developer conveyor when a maximum pushing force is applied by the first developer conveyor to the developer toward the second developer conveyor through the communication opening and the first developer conveyor is viewed from the side wall of the second developer conveyor having the developer drain hole, the rotational phases of the first developer conveyor, the second developer conveyor, and the third developer conveyor fixed and synchronized with each other so that an axial position of a bottom of an outer circumference of the spiral blade of the third developer conveyor disposed upstream in a developer conveying direction closest to the developer drop hole in an axial direction thereof is separated from a position of an upstream end of the developer drop hole in a developer conveying direction on an imaginary plane vertically extended including an axis of a rotary shaft of the third developer conveyor.

18. The image forming apparatus as claimed in claim 13, wherein rotational phases of the first developer conveyor and the second developer conveyor are fixed and synchronized with each other to maximize a region of the first developer conveyor hidden by the spiral blade of the second developer conveyor located below a rotary shaft of the second developer conveyor when a maximum pushing force is applied by the first developer conveyor to the developer toward the second developer conveyor through the communication opening and the first developer conveyor is viewed from the side wall of the second developer conveyance channel having the developer drain hole.

19. The image forming apparatus as claimed in claim 13, further comprising a paddle attached to the first developer conveyor, the paddle opposed to the communication opening to apply force to the developer in a rotational direction of the first developer conveyor.

20. The image forming apparatus as claimed in claim 13, further comprising:

a first driving gear attached to the first developer conveyor;

a second driving gear attached to the second developer conveyor; and at least one synchronizing idler gear engaged with both the first driving gear and the second driving gear, wherein rotational driving force is transmitted from one of the first driving gear and the second driving gear to the other one of the first driving gear and the second driving gear, respectively, via the at least one synchronizing idler gear.

21. A developing unit comprising:

a developer bearer to bear developer on a surface thereof;

a first developer conveyor having a spiral blade mounted on a rotary shaft thereof parallel to a rotary axis of the developer bearer to convey developer in a first direction;

a second developer conveyor having a spiral blade mounted on a rotary shaft thereof parallel to the rotary axis of the developer bearer to convey developer in a second direction opposite the first direction;

a first developer conveyance channel including the first developer conveyor;

a second developer conveyance channel including the second developer conveyor;

a partition wall to separate the first developer conveyance channel and the second developer conveyance channel from each other;

a communication opening in the partition wall to communicate the first developer conveyance channel with the second developer conveyance channel at a position near a downstream end of the first developer conveyance channel and an upstream end of the second developer conveyance channel, each of the downstream end and the upstream end horizontally aligned with each other, and a developer drain hole to drain the developer from the developing unit, the developer drain hole provided in a side wall of the second developer conveyance channel to face the communication opening across the second developer conveyor, wherein the first developer conveyor rotates in a direction with the spiral blade thereof rising between the rotary shaft of the first developer conveyor and the communication opening, wherein the first developer conveyor includes a paddle disposed facing the communication opening in the partition wall, the paddle configured to apply, to the developer, force in the direction in which the first developer conveyor rotates, and wherein, rotational phases of the first developer conveyor and the second developer conveyor relative to each other are fixed to maximize a region of the first developer conveyor hidden by a lower portion of the spiral blade of the second developer conveyor located below the rotary shaft of the second developer conveyor, as viewed at the first developer conveyor from the side wall in which the developer drain hole is disposed, when the paddle is at a vertically downward position.

22. The developing unit as claimed in claim 21, further comprising:

a first driving gear attached to the first developer conveyor;

a second driving gear attached to the second developer conveyor; and at least one synchronizing idler gear engaged with both the first driving gear and the second driving gear, wherein rotational driving force is transmitted from one of the first driving gear and the second driving gear to the other one of the first driving gear and the second driving gear, respectively, via the at least one synchronizing idler gear.

23. The developing unit as claimed in claim 21, further comprising a timing bell to transmit rotational driving force transmitted to one of the first developer conveyor and the second developer conveyor to the other one of the first developer conveyor and the second developer conveyor.

* * * * *